US009093804B2

(12) United States Patent
Matocky et al.

(10) Patent No.: US 9,093,804 B2
(45) Date of Patent: Jul. 28, 2015

(54) APPARATUS FOR CONNECTING A SHARED DC BUS LINK

(71) Applicant: Rockwell Automation Technologies, Inc., Mayfield Heights, OH (US)

(72) Inventors: Mathew S. Matocky, Mequon, WI (US); Kelly J. Bronk, Kewaskum, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 49 days.

(21) Appl. No.: 14/046,458

(22) Filed: Oct. 4, 2013

(65) Prior Publication Data

US 2015/0099378 A1 Apr. 9, 2015

(51) Int. Cl.

| | |
|---|---|
| ***H01R 25/14*** | (2006.01) |
| ***H01R 12/70*** | (2011.01) |
| ***H01R 31/02*** | (2006.01) |

(52) U.S. Cl.

CPC ..... *H01R 25/142* (2013.01); *H01R 12/7088* (2013.01); *H01R 31/02* (2013.01)

(58) Field of Classification Search

USPC ..... 439/110, 212, 215, 249; 361/741

See application file for complete search history.

(56) References Cited

U.S. PATENT DOCUMENTS

| | | | | |
|---|---|---|---|---|
| 4,195,194 | A | 3/1980 | Kuster et al. | |
| 4,423,917 | A | 1/1984 | Scheingold et al. | |
| 4,475,781 | A | 10/1984 | Asick et al. | |
| 4,721,471 | A | 1/1988 | Mueller | |
| 5,024,627 | A * | 6/1991 | Bennett et al. | 439/631 |
| 5,073,120 | A | 12/1991 | Lincoln et al. | |
| 5,203,724 | A | 4/1993 | Casey | |
| 5,252,086 | A | 10/1993 | Russell et al. | |
| 5,670,743 | A | 9/1997 | Welch et al. | |
| 6,066,921 | A * | 5/2000 | Nakamura et al. | 315/71 |
| 6,201,350 | B1 * | 3/2001 | Okuchi et al. | 315/82 |
| 7,053,302 | B2 * | 5/2006 | Bjorklund et al. | 174/68.2 |
| 7,527,523 | B2 * | 5/2009 | Yohn et al. | 439/564 |
| 7,905,737 | B2 * | 3/2011 | Byrne | 439/215 |
| 8,686,288 | B2 * | 4/2014 | Kalayjian et al. | 174/68.2 |
| 8,811,050 | B2 * | 8/2014 | Hotta et al. | 363/144 |

(Continued)

FOREIGN PATENT DOCUMENTS

EP 1998407 A2 12/2008

OTHER PUBLICATIONS

Tyco Electronics, 114-19128; Dec. 2010—(8) pages.

(Continued)

*Primary Examiner* — Alexander Gilman

(74) *Attorney, Agent, or Firm* — Boyle Fredrickson, S.C.

(57) ABSTRACT

A system for connecting a shared DC bus between multiple power converters is disclosed. The DC bus includes a positive and a negative rail across which the DC voltage is present. A pair of DC bus stabs is mounted to a PCB within the power converter. Each DC bus stab is electrically connected to either the positive or negative rail. A connector assembly is mounted to the housing of the power converter such that a first receptacle engages a plug portion of the DC bus stab. The connector assembly also includes a second receptacle extending to the exterior of the power converter. The connector assembly is positioned on each power converter such that a known distance, or one of a number of known distances, is established between adjacent connector assemblies. A DC bus assembly extends between and is plugged into the second receptacle of the two adjacent connector assemblies.

19 Claims, 18 Drawing Sheets

(56) References Cited

U.S. PATENT DOCUMENTS

| | | | | |
|---|---|---|---|---|
| 2008/0105476 | A1* | 5/2008 | Korich et al. | 180/65.2 |
| 2009/0047814 | A1 | 2/2009 | Daamen | |
| 2010/0062627 | A1* | 3/2010 | Ambo et al. | 439/189 |
| 2011/0261508 | A1 | 10/2011 | Ross et al. | |
| 2012/0264317 | A1* | 10/2012 | Balcerak et al. | 439/212 |
| 2013/0012072 | A1 | 1/2013 | Costello et al. | |

OTHER PUBLICATIONS

Tyco Electronics, Crown Clip Junior, Catalog 1654261-8; Sep. 2008—(8) pages.

Extended European Search Report (EESR) dated Feb. 26, 2015; European Patent Application No. 14187273.9—(5) pages.

* cited by examiner

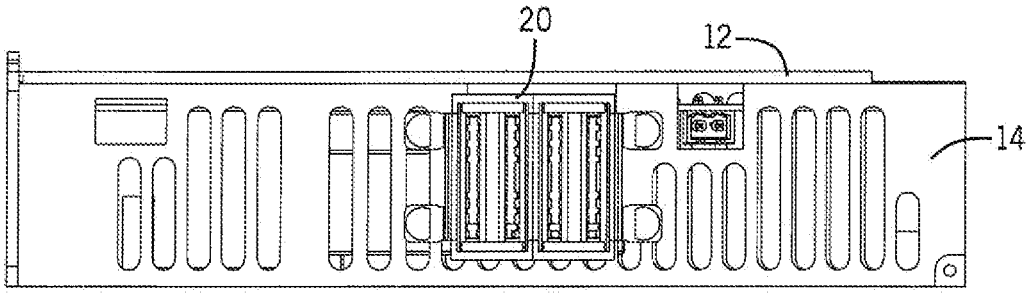
FIG. 2
FIG. 3
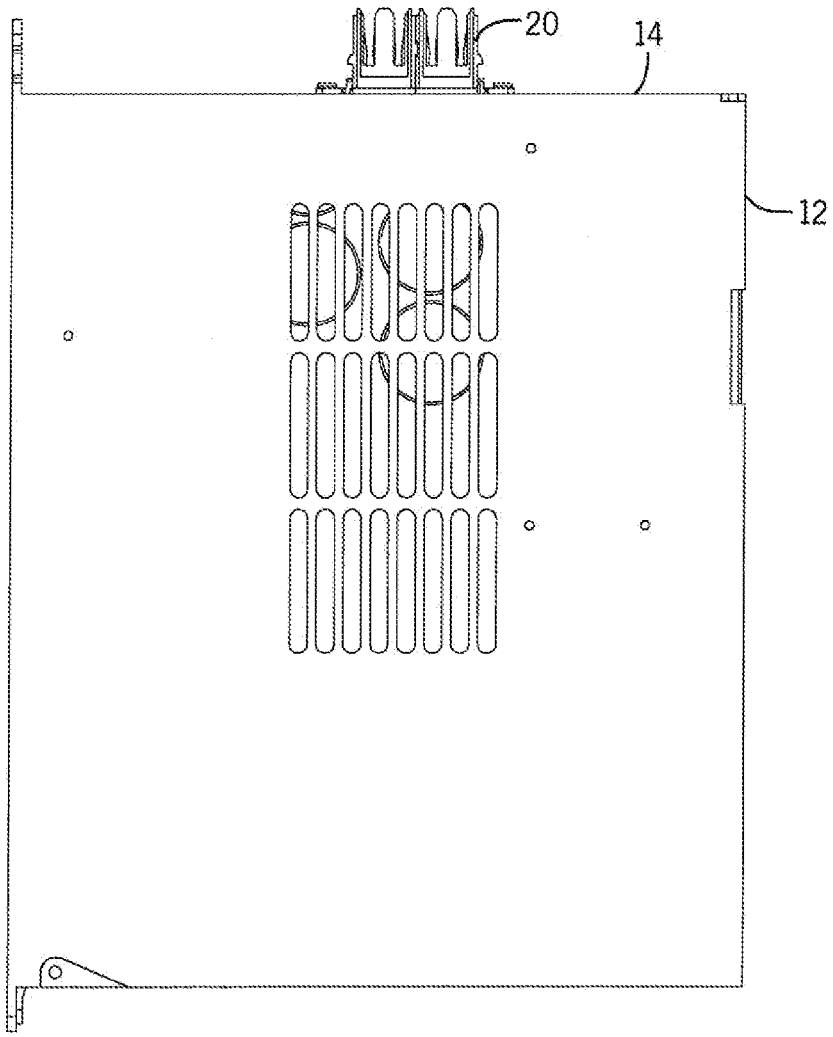

APPARATUS FOR CONNECTING A SHARED DC BUS LINK

BACKGROUND OF THE INVENTION

The subject matter disclosed herein relates generally to a system for connecting power between devices and, more specifically, to a system for electrically connecting a shared direct current (DC) bus between multiple power converters.

As is known to those skilled in the art, power converters are utilized in numerous applications to convert power from one form to another. Power converters may, for example, convert power generated by an alternating current (AC) power supply to DC power or power generated by a DC power supply to AC power. Power converters are also utilized to convert DC power at a first voltage potential to a second voltage potential or to supply AC voltage having a variable amplitude and variable frequency.

One exemplary use of power converters is to provide voltage for the control of an AC motor. An inverter, for example, converts power from a DC source to an AC output connected to the motor. The AC output has a varying amplitude and/or varying frequency to control the torque and/or speed at which the motor operates. The DC source is commonly referred to as a DC bus. The DC bus, in turn, typically receives power from a second power converter. If the DC bus is receiving power from an energy storage device, such as a battery, the power converter may be a DC-to-DC converter which converts power having a first voltage potential present on the energy storage device to a second voltage potential present on the DC bus. If the DC bus is receiving energy from an AC power source, such as the utility grid, the power converter may be an AC-to-DC converter which converts the AC voltage to a DC voltage on the DC bus.

It certain applications, such as a process line or a machining center, there may be multiple motors, each controlling a different axis of motion, which receive their power from the utility grid. It may be advantageous to provide a single AC-to-DC converter, or rectifier, having sufficient power rating to provide power for each motor converting the AC power from the utility grid to the DC power on the DC bus. Each motor may then have an associated inverter connected to the shared DC bus and be configured to provide AC power to the motor to control operation of the motor. In such a configuration, it is necessary to connect each of the inverters to the DC bus in order for them to receive power from the DC bus.

Presently, the rectifier and each inverter may be mounted proximate to each other in a control cabinet. Each of the power converters may include a set of terminals having, for example, a screw clamp, configured to secure an appropriate gauge electrical conductor, or a bolt hole, through which a bolt may secure a lug which is, in turn, crimped to the electrical conductor. The screw or bolt mechanical connection is desired due to the amplitude of voltage and/or current that may be present on the DC bus. For example, a 230 VAC motor requires a DC voltage potential of about 325 VDC or more to be present on the DC bus and the current may be tens or hundreds of amps. The electrical conductor may be an insulated wire or cable depending on the power requirements of the application. Optionally, solid conductive bars, such as copper bars, may be stamped or manufactured that are secured between power converters.

However, such systems have not been fully met without incurring various disadvantages. Installation and maintenance of the drives requires securing the electrical conductors to the power converters. If more than two power converters are sharing the DC bus, the technician must be trained to properly chain the converters in series and for each converter located in series between two other converters, multiple conductors need to be secured to the power converter.

Thus, it would be desirable to provide a system for connecting power converters sharing a DC bus that provides for easier installation and maintenance.

BRIEF DESCRIPTION OF THE INVENTION

The subject matter disclosed herein describes a system for connecting a shared DC bus between multiple power converters. The DC bus includes a positive rail and a negative rail across which the DC voltage is present. A pair of DC bus stabs is mounted to a printed circuit board (PCB) within the power converter, and each DC bus stab is electrically connected to either the positive or negative rail of the DC bus. Each DC bus stab includes a plug portion which is complementary to a first receptacle of a connector assembly. The connector assembly is mounted to the housing of the power converter such that the first receptacle, engages the plug portion of the DC bus stab, establishing an electrical connection between the DC bus stab and the connector assembly. The connector assembly also includes a second receptacle extending to the exterior of the power converter. Two power converters, each having the DC bus stab and connector assembly may be mounted adjacent to each other. The connector assembly is positioned on each power converter such that a known distance, or one of a number of known distances, is established between adjacent connector assemblies. A DC bus assembly extends between and is plugged into the second receptacle of the two adjacent connector assemblies, establishing a shared DC bus between adjacent power converters.

According to one embodiment of the invention, a connector system configured to share a DC bus between a first power converter and a second power converter is disclosed. The connector system includes a first DC bus stab having a plug portion and a mounting portion configured to be mounted to a first PCB and a second DC bus stab having a plug portion and a mounting portion configured to be mounted to a second PCB. The first PCB is mounted within the first power converter, and the second PCB is mounted within the second power converter. A first connector assembly includes a first receptacle configured to receive the plug portion of the first DC bus stab and a second receptacle configured to extend outside the first power converter. A second connector assembly includes a first receptacle configured to receive the plug portion of the second DC bus stab and a second receptacle configured to extend exterior to the second power converter. The connector system also includes a bus bar assembly. The bus bar assembly includes a bus bar and a non-conductive housing. The bus bar has a first end configured to be inserted into the second receptacle of the first connector, assembly and a second end configured to be inserted into, the second receptacle of the second connector assembly. The non-conductive housing encloses at least a portion of the bus bar between the first end and the second end.

According to another embodiment of the invention, a connector for a device configured to share at least one power rail includes a stab and a connector assembly. The stab has a first portion and a second portion, where the first portion is configured to be mounted to a PCB to establish an electrical connection with a first power rail within the device. The connector assembly includes a first receptacle configured to receive the second portion of the stab and a second receptacle configured to extend outside of a housing for the device. The second receptacle is configured to receive a first bus bar in a first portion of the second receptacle, to receive a second bus bar in a second portion of the second receptacle, and to establish an electrical connection between the first bus bar, the second bus bar, and the first power rail within the device.

According to yet another embodiment of the invention, a connector for a shared DC bus having a positive rail and a negative rail is disclosed. The connector includes a first DC bus stab, a second DC bus stab, a first connector assembly, and a second connector assembly. The first DC bus stab has a first portion and a second portion, where the first portion is configured to be mounted to a PCB and electrically connected to the positive rail of the DC bus. The second DC bus stab has a first portion and a second portion, where the first portion is configured to be mounted to the PCB and electrically connected to the negative rail of the DC bus. The first connector assembly includes a first receptacle, configured to receive the second portion of the first DC bus stab, and a second receptacle. The second receptacle of the first connector assembly is configured to receive a first bus bar in a first portion of the second receptacle, to receive a second bus bar in a second portion of the second receptacle, and to establish an electrical connection between the first bus bar, the second bus bar, and the positive rail of the DC bus via the first connector assembly and the first DC bus stab. The second connector assembly includes a first receptacle, configured to receive the second portion of the second DC bus stab, and a second receptacle. The second receptacle of the second connector assembly is configured to receive a third bus bar in a first portion of the second receptacle, to receive a fourth bus bar in a second portion of the second receptacle, and to establish an electrical connection between the third bus bar, the fourth bus bar, and the negative rail of the DC bus via the second connector assembly and the second DC bus stab.

These and other advantages and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Various exemplary embodiments of the subject matter disclosed herein are illustrated in the accompanying drawings in which like reference numerals represent like parts throughout, and in which:

FIG. 2 is a top plan view of one motor drive including a connector assembly of the shared DC bus link from FIG. 1;

FIG. 3 is a side, elevation view of the motor drive and the connector assembly of FIG. 2;

Figure 1:
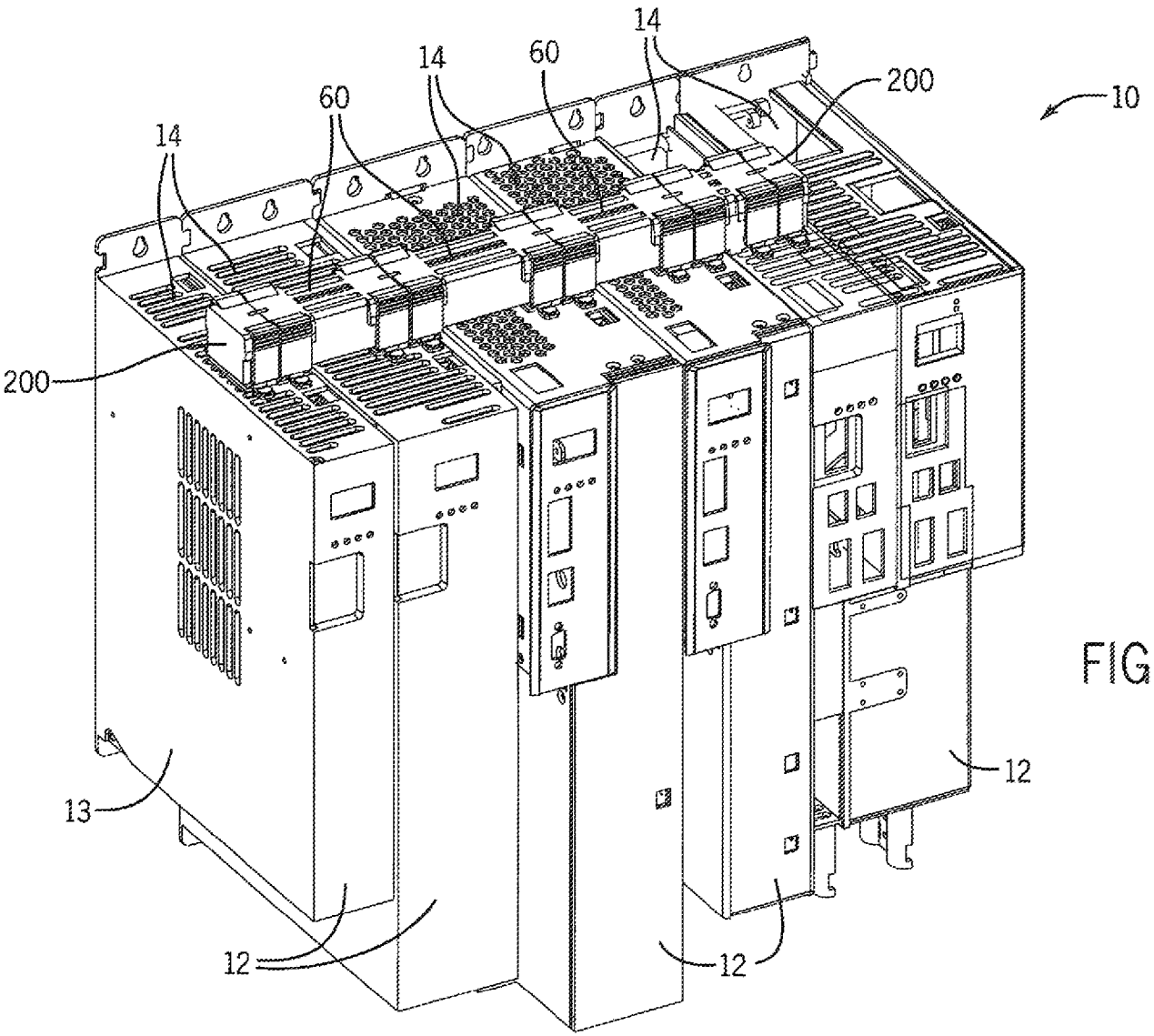
FIG. 1 is an isometric view of an exemplary multi-axis drive system incorporating a shared DC bus link according to one embodiment of the invention.

In describing the various embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used They are not limited to direct connection but include connection through other elements where such connection is recognized as being equivalent by those skilled in the art.

DETAILED DESCRIPTION OF THE PREFERRED EMBODIMENTS

Turning initially to FIG. 1, an exemplary multi-axis drive system utilizing a shared DC bus is illustrated. The multi-axis drive system includes multiple devices, such as power converters 12, where each power converter 12 may include, for example, an inverter to convert a DC voltage to an AC voltage, a rectifier to convert an AC voltage to a DC voltage, a converter to convert a DC voltage at a first voltage potential to a DC voltage at a second voltage potential, or a combination thereof. A connector system 10 for the multi-axis drive system allows for a fast, safe connection between the DC busses of the different power converters 12. Optionally, the device may be another industrial control device, including, for example, an input module, output module, or a network module having a common power bus, such as a 24 VDC control power, extending therebetween. The connector system 10 allows for a fast, modular connection of the shared bus between devices.

Figure 4:
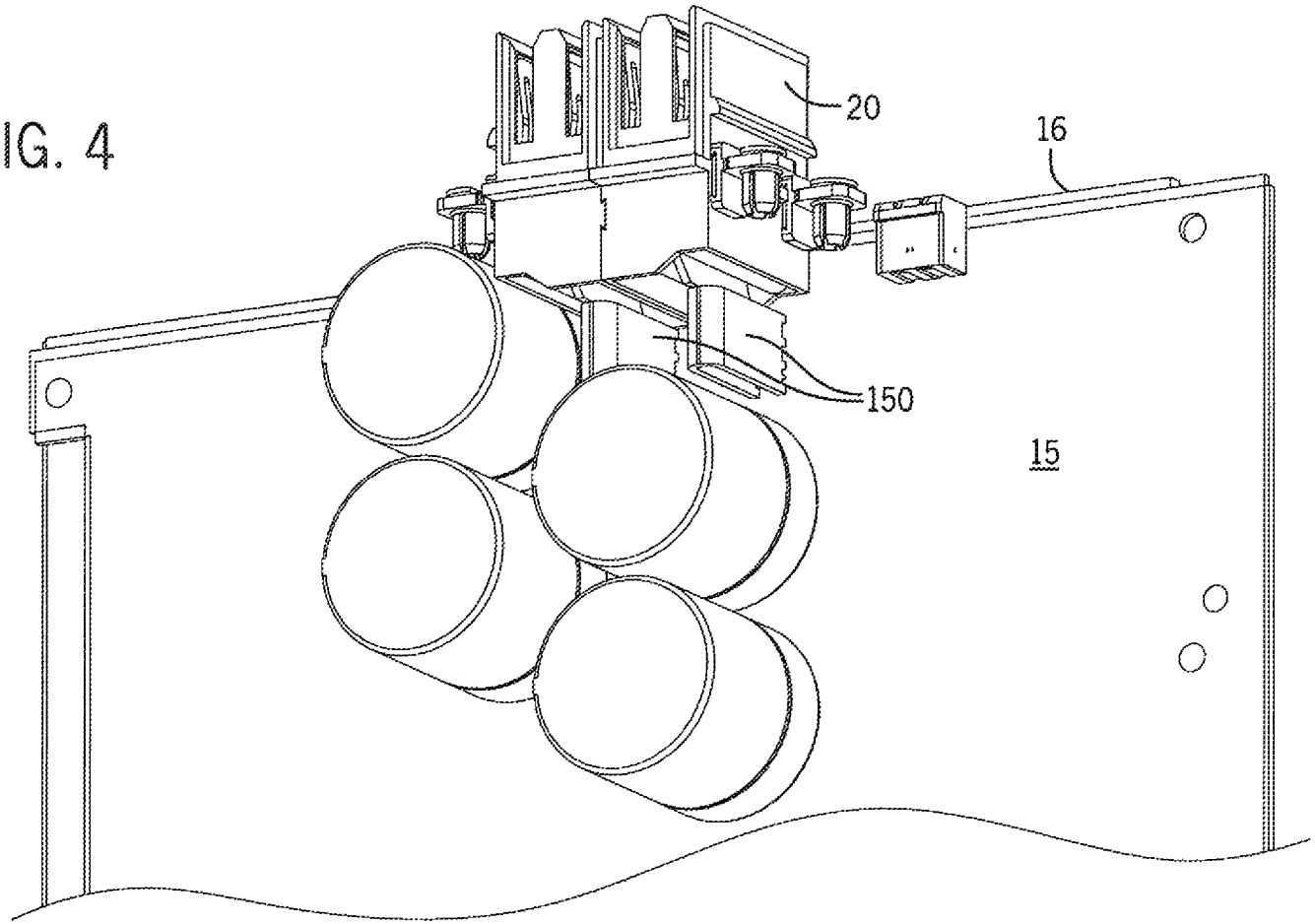
FIG. 4 is an isometric view of a circuit board from the motor drive of FIG. 3 with a DC bus stab and the connector assembly.
Figure 5:
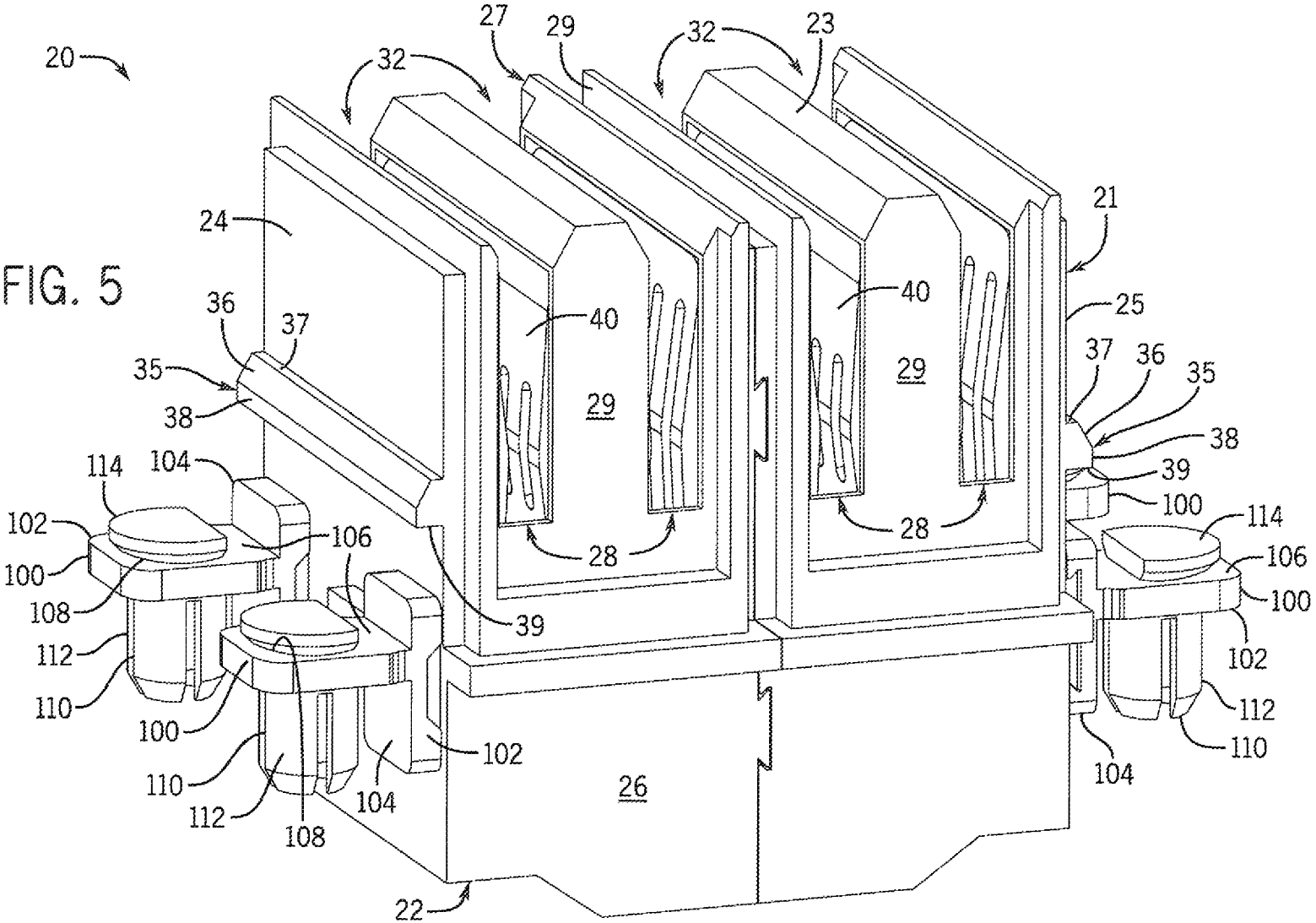
FIG. 5 is an isometric view of a connector assembly for the shared DC bus link according to one embodiment of the invention.
Figure 6:
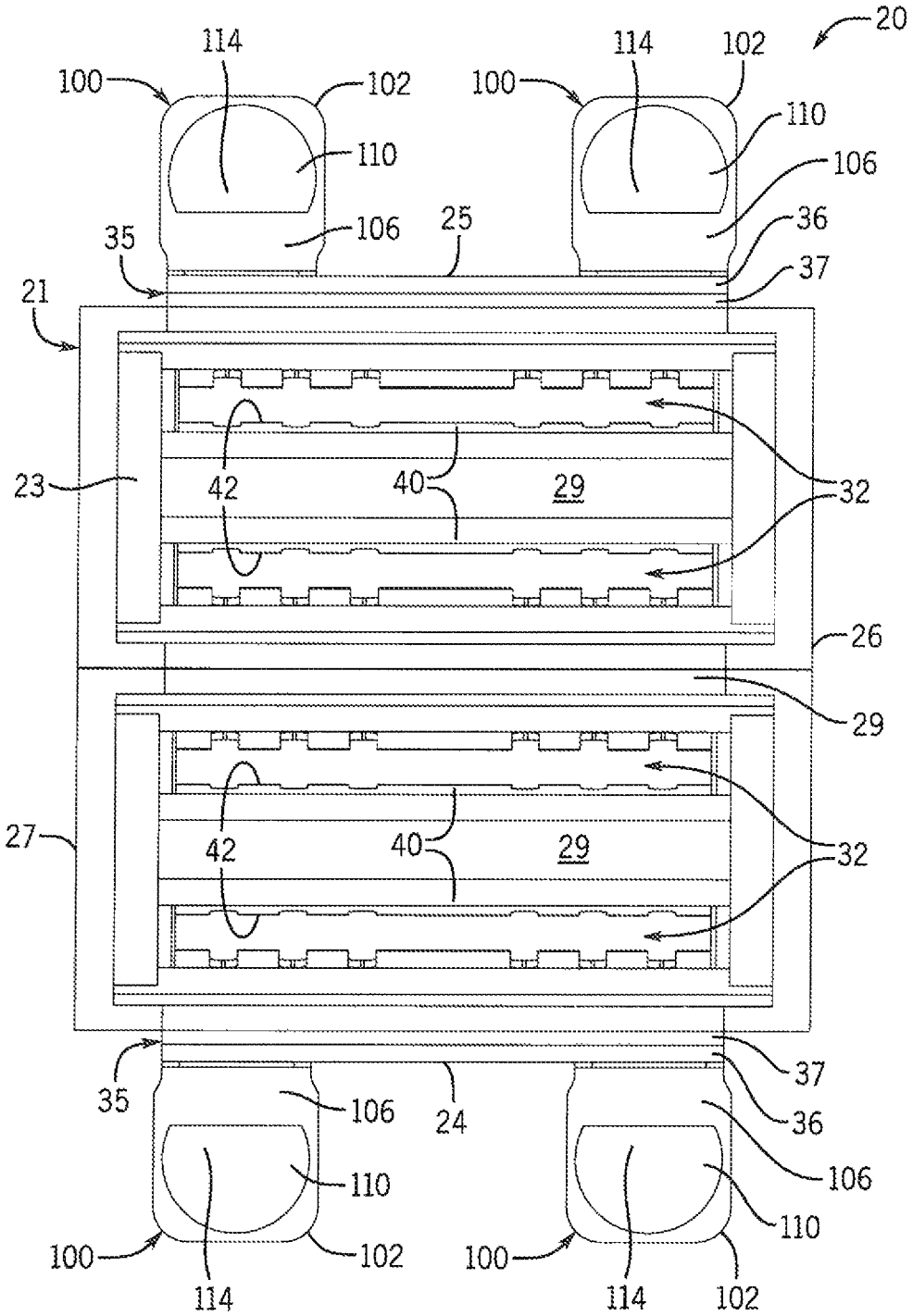
FIG. 6 is a top plan view of the connector assembly of FIG. 5.
Figure 7:
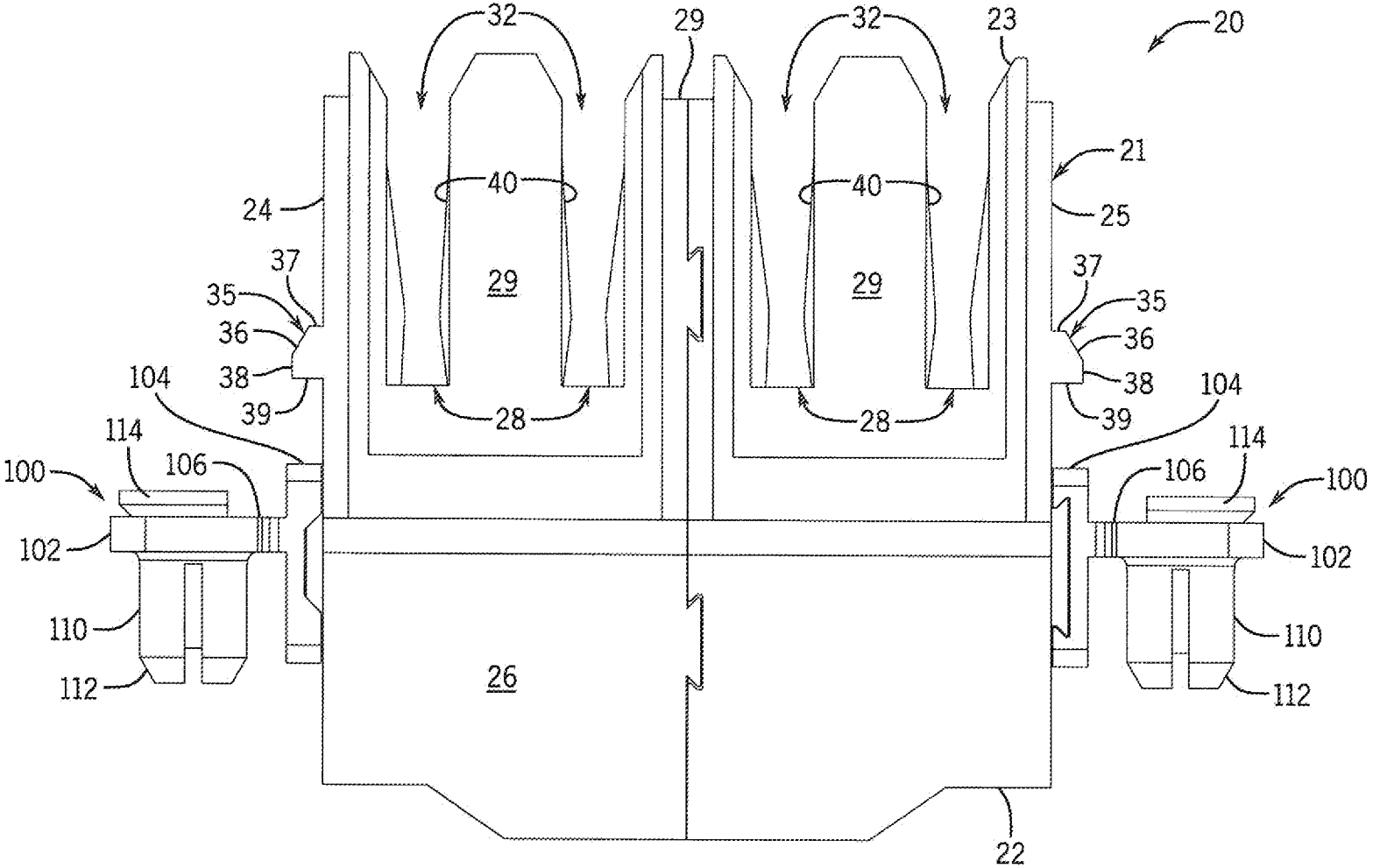
FIG. 7 is a side elevation view of the connector assembly of FIG. 5.
Figure 9:
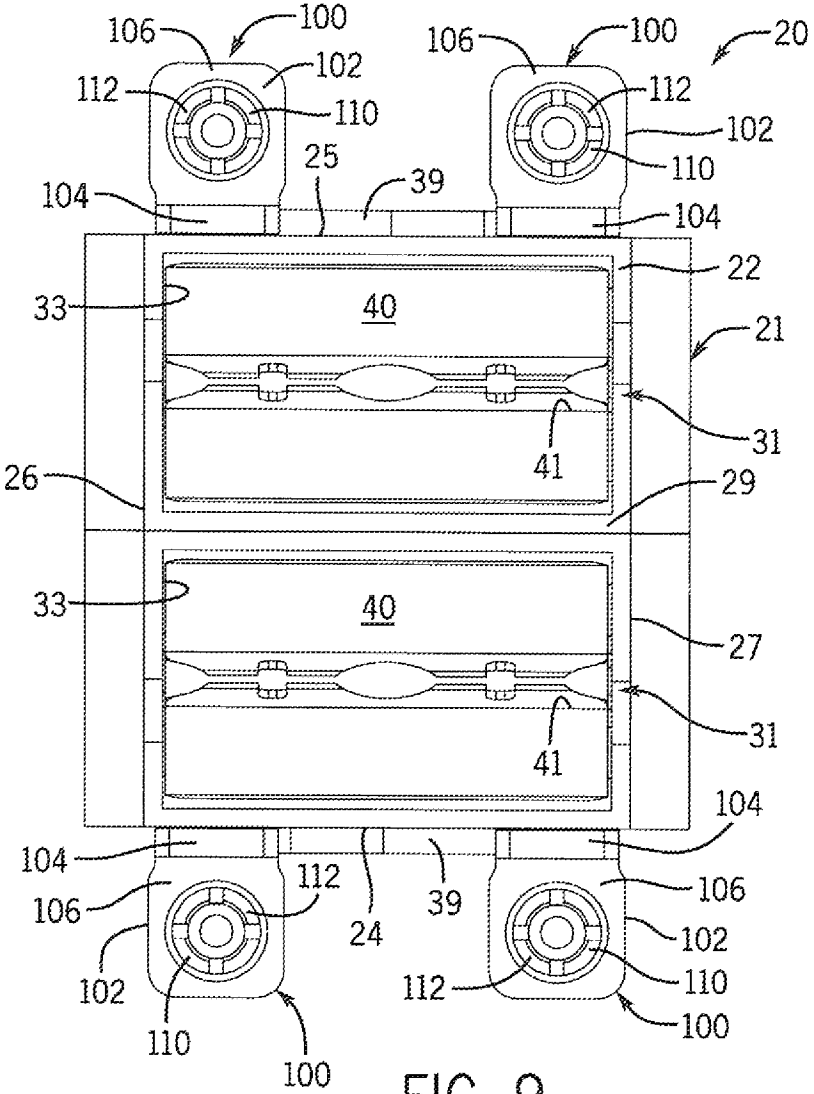
FIG. 9 is a bottom plan view of the connector assembly of FIG. 5.
Figure 8:
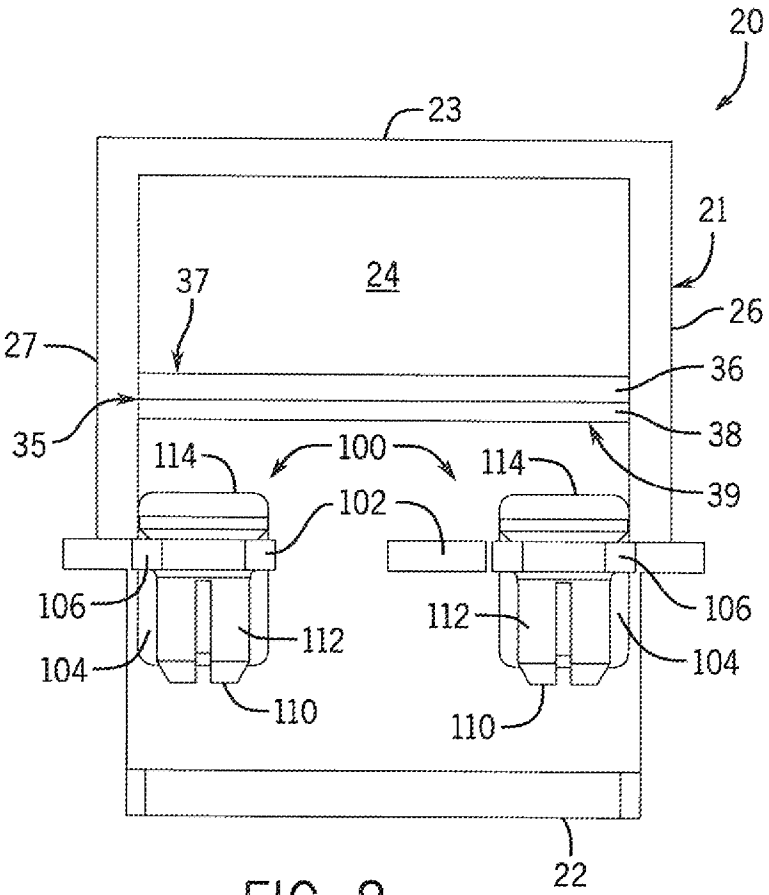
FIG. 8 is an end elevation view of the connector assembly of FIG. 5.
Figure 10:
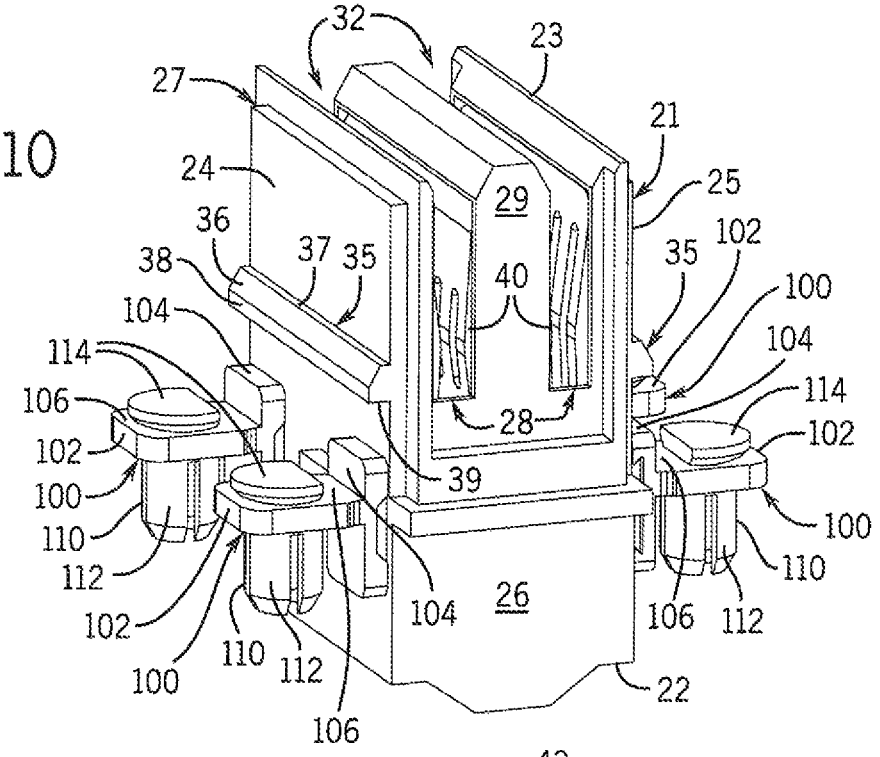
FIG. 10 an isometric view of the connector assembly for the shared DC bus link according to another embodiment of the invention.
Figure 11:
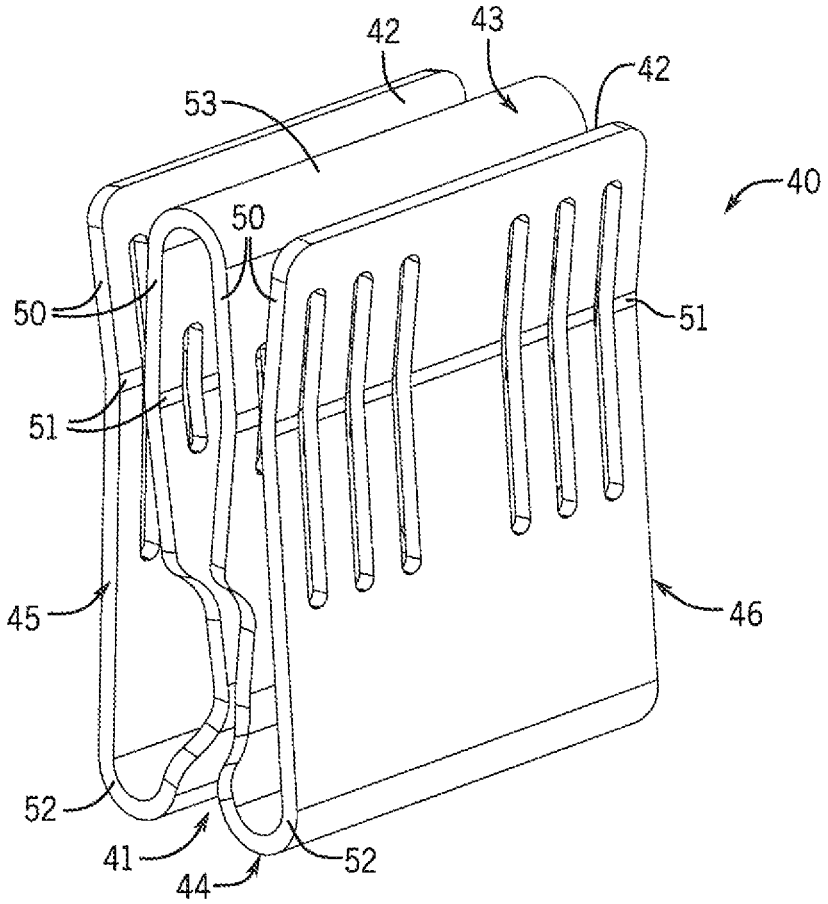
FIG. 11 is an isometric view of a contact for the connector assembly of FIG. 5.
Figure 12:
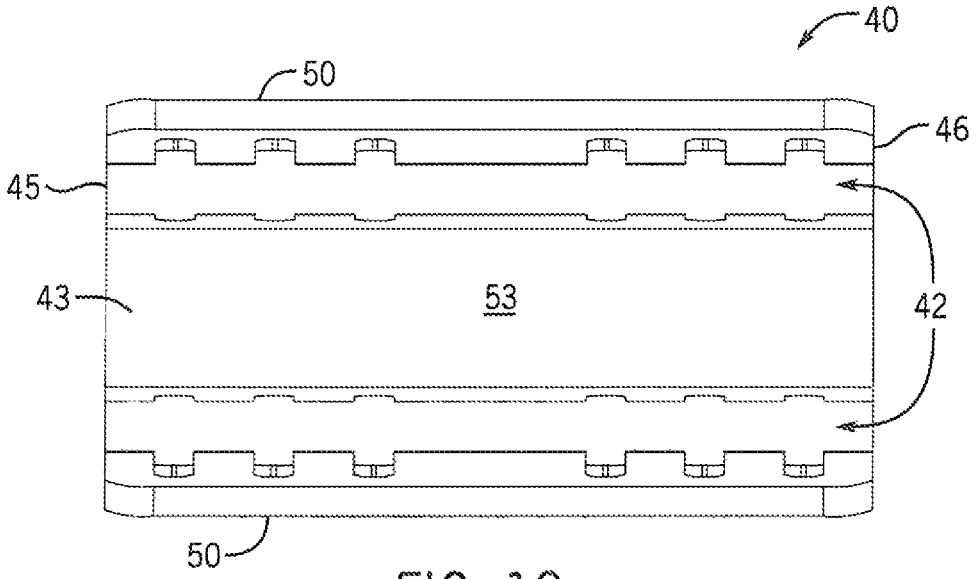
FIG. 12 is a top plan view of the contact of FIG. 11.
Figure 13:
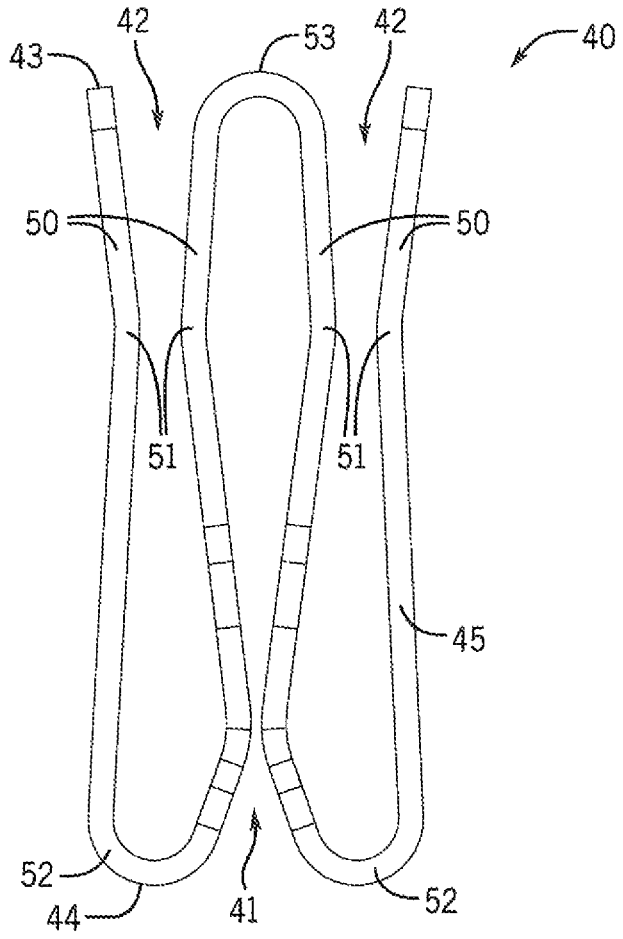
FIG. 13 is a side elevation view of the contact of FIG. 11.
Figure 14:
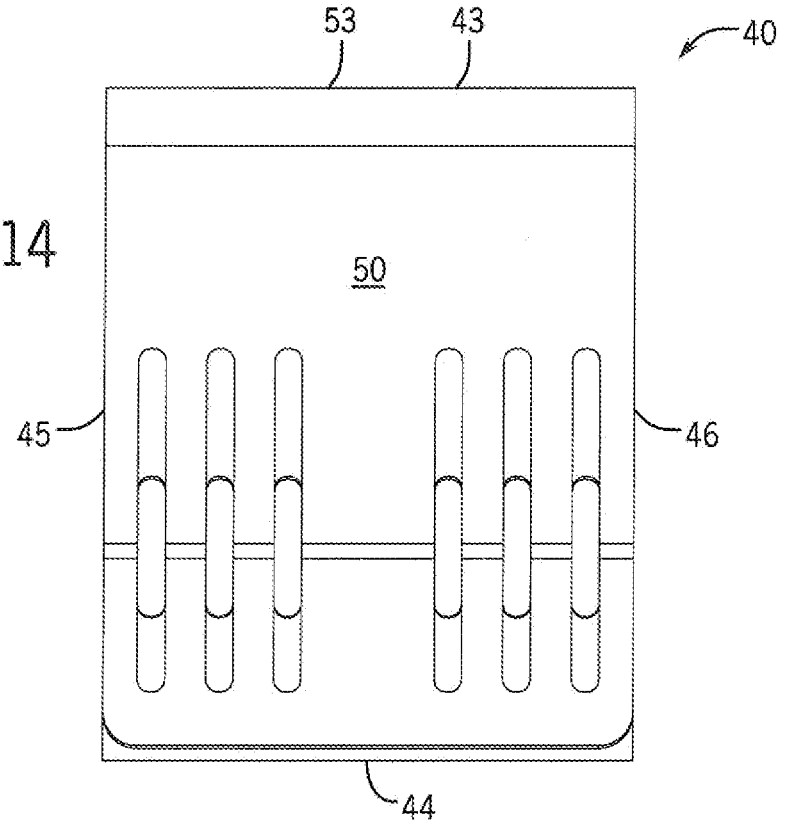
FIG. 14 is an end elevation view of the contact of FIG. 11.
Figure 15:
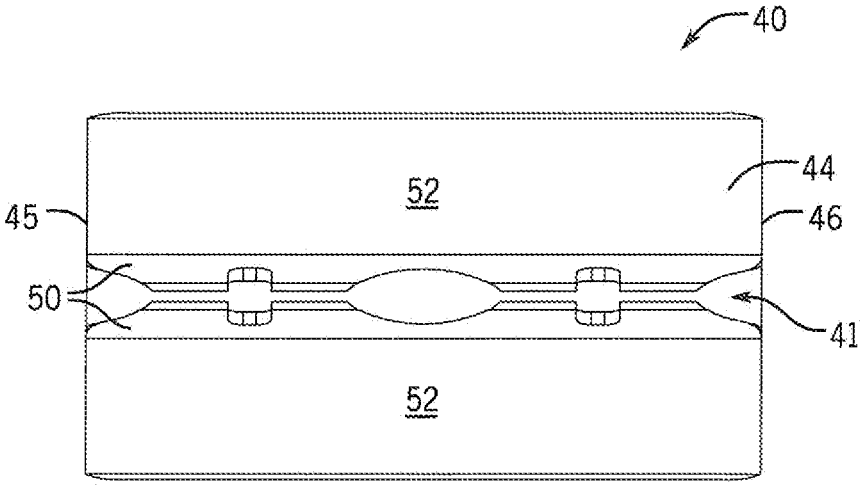
FIG. 15 is a bottom plan view of the contact of FIG. 11.
Figure 16:
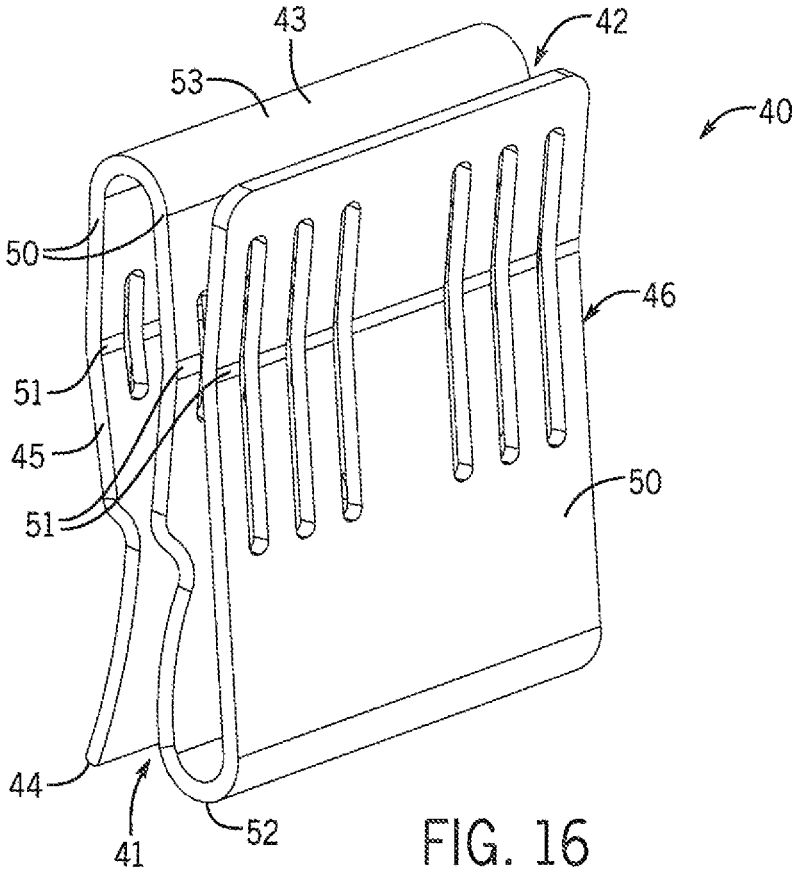
FIG. 16 an isometric view of a contact for the connector assembly of FIG. 10.
Figure 17:
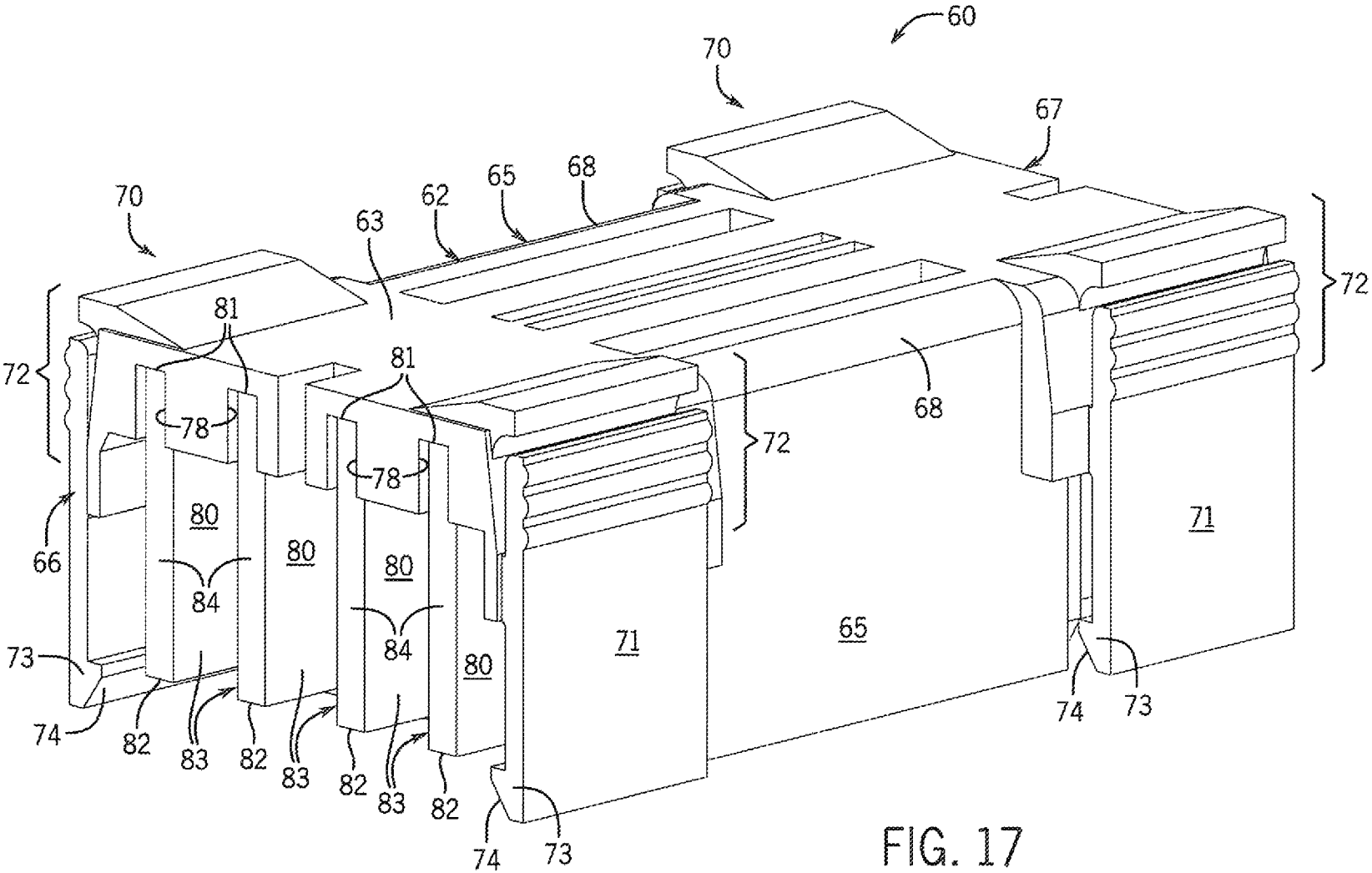
FIG. 17 is an isometric view of a bus bar assembly for the shared DC bus link according to one embodiment of the invention.
Figure 18:
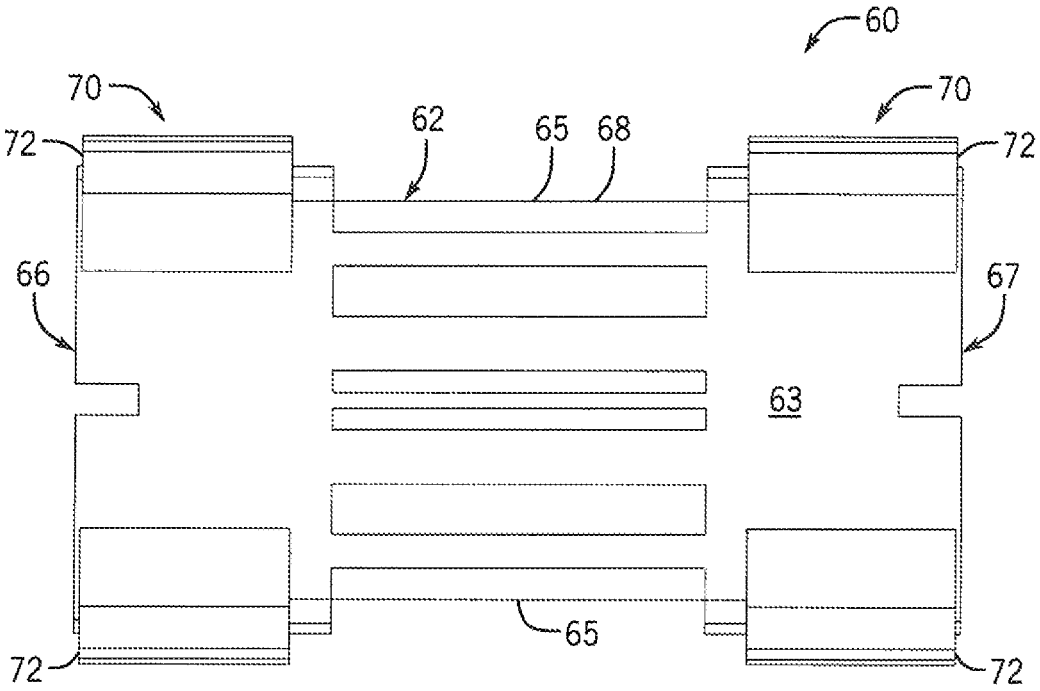
FIG. 18 is a top plan view of the bus bar assembly of FIG. 17.
Figure 19:
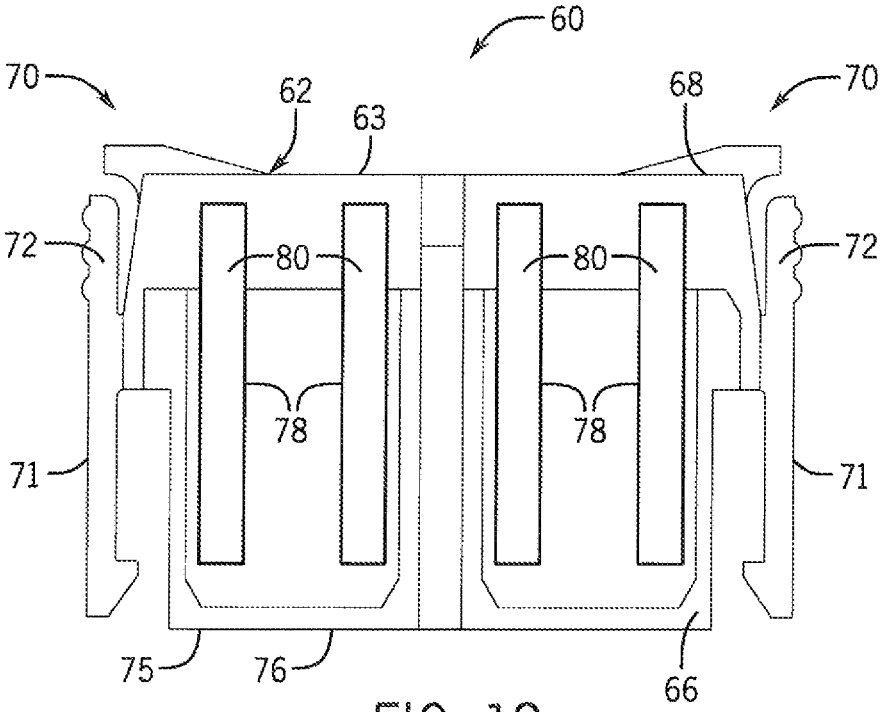
FIG. 19 is a side elevation view of the bus bar assembly of FIG. 17.
Figure 20:
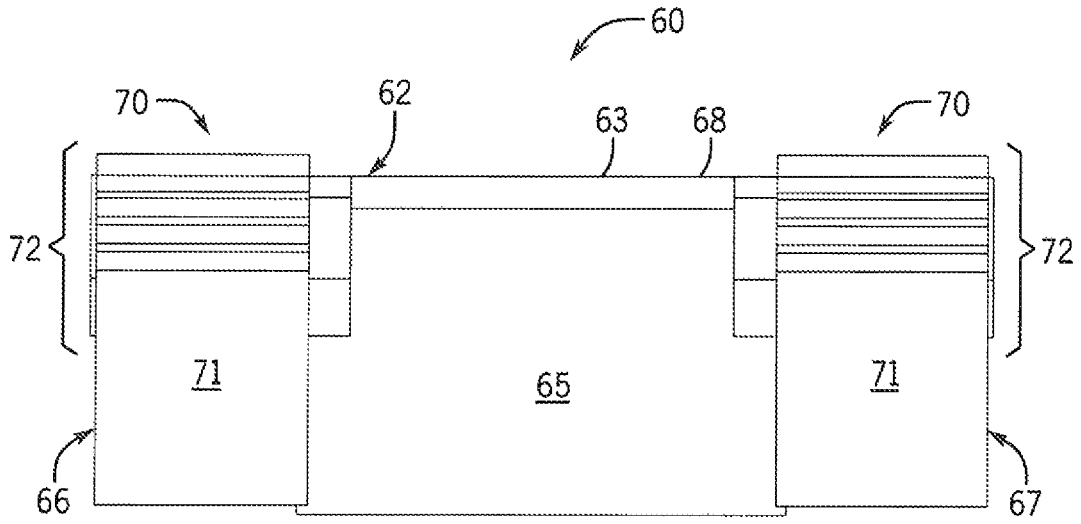
FIG. 20 is an end elevation view of the bus bar assembly of FIG. 17.
Figure 21:
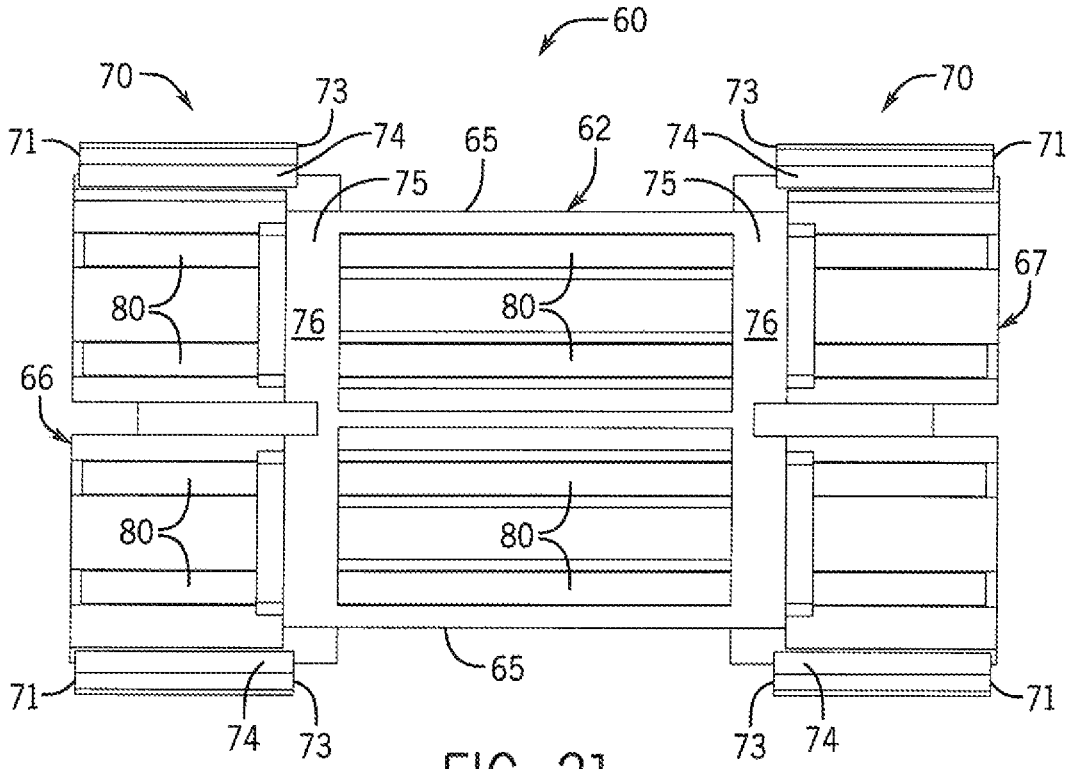
FIG. 21 is a bottom plan view of the bus bar assembly of FIG. 17.
Figure 22:
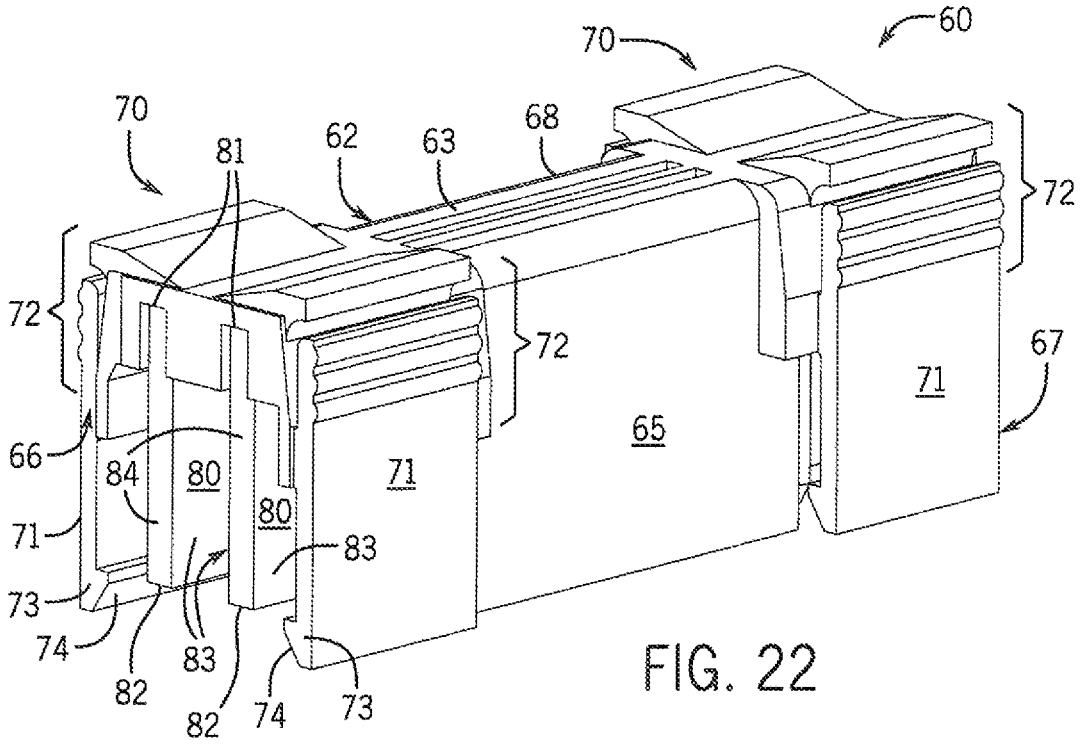
FIG. 22 an isometric view of a bus bar assembly for the shared DC bus link according to another embodiment of the invention.
Figure 23:
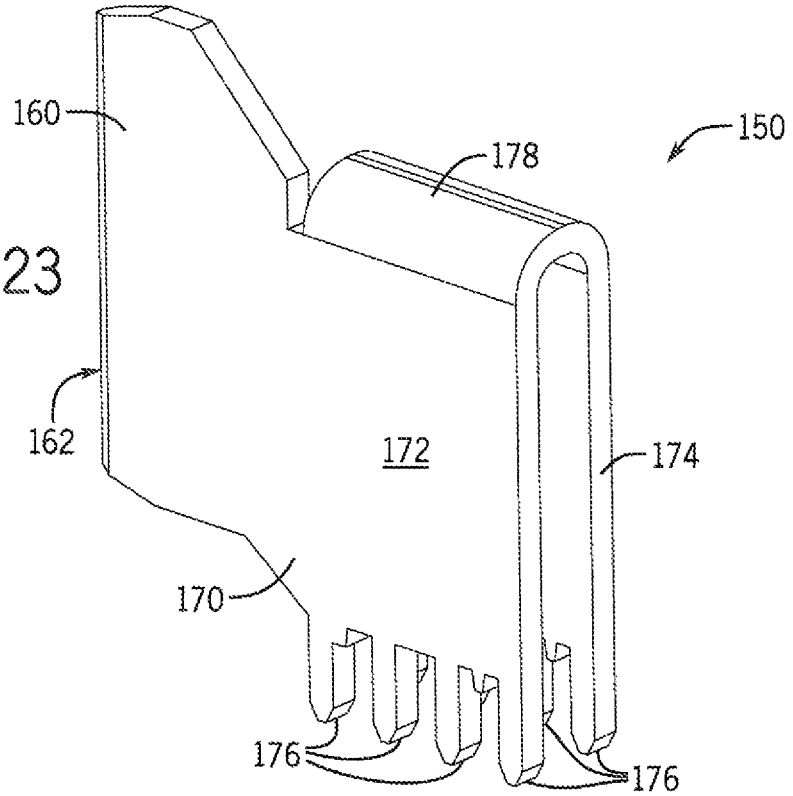
FIG. 23 is an isometric view of a DC bus stab for the shared DC bus link according to one embodiment of the invention.
Figure 24:
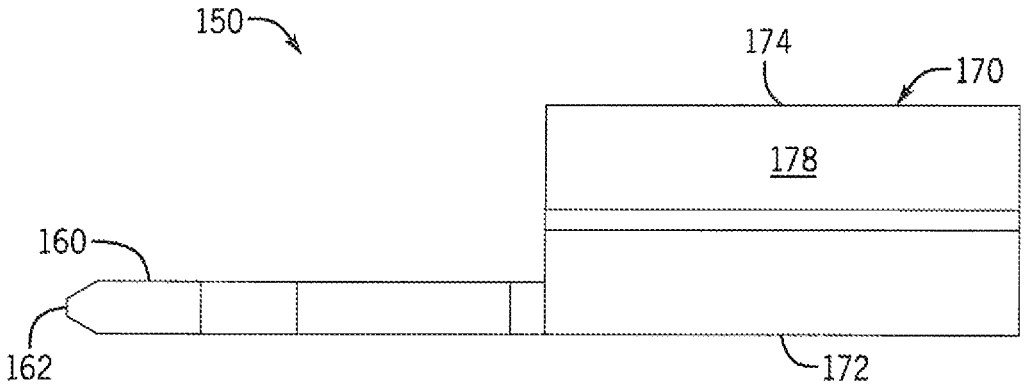
FIG. 24 is a top plan view of the DC bus stab of FIG. 23.
Figure 25:
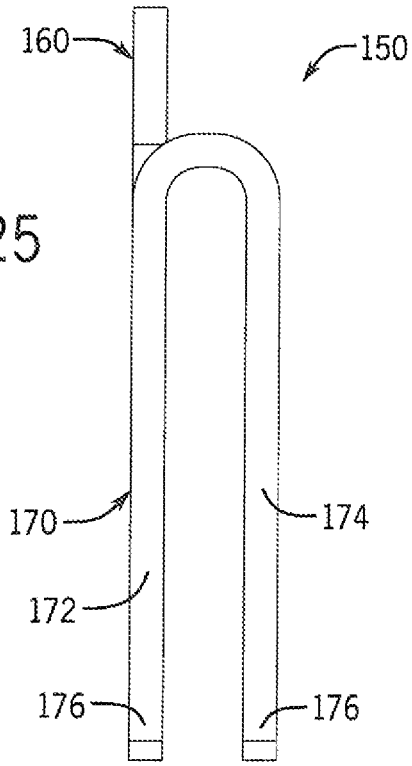
FIG. 25 is a side elevation view of the DC bus stab of FIG. 23.
Figure 26:
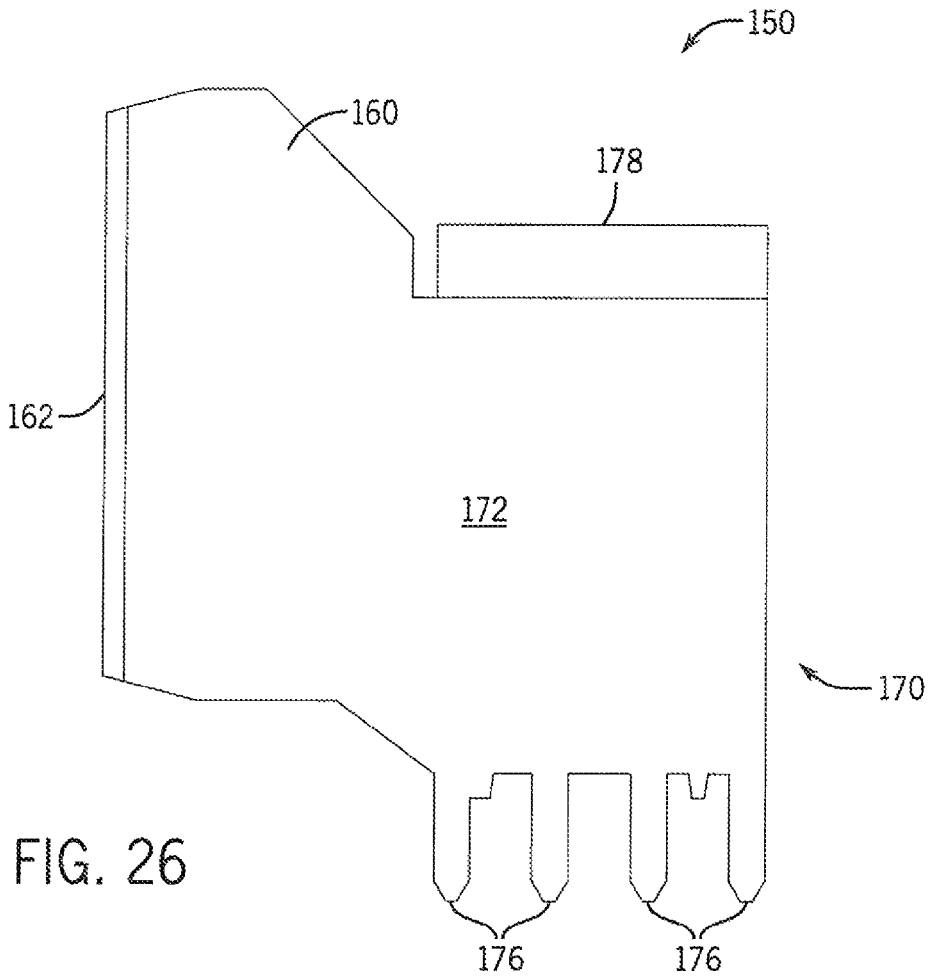
FIG. 26 is an end elevation view of the DC bus stab of FIG. 23.
Figure 27:
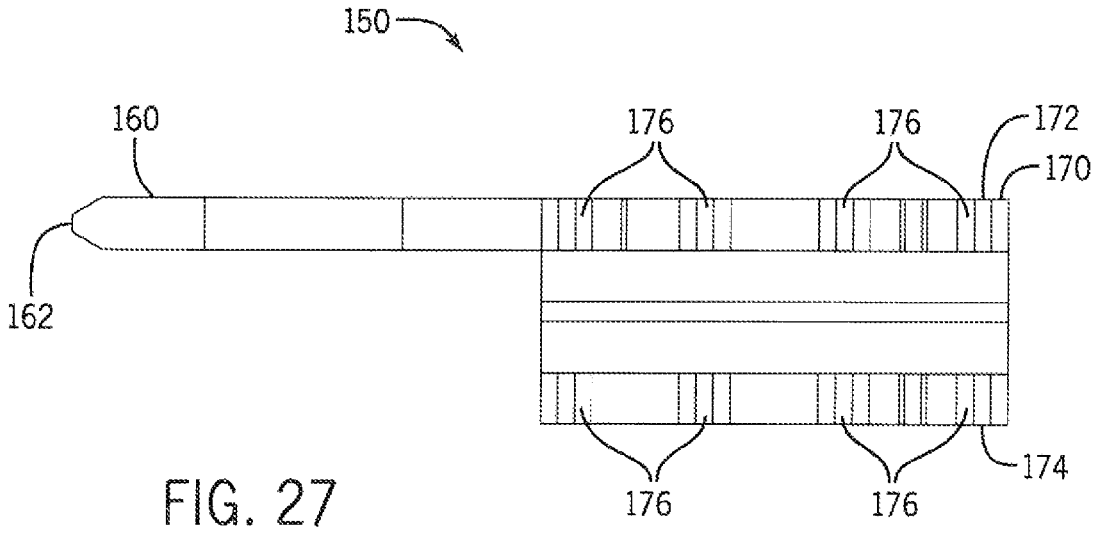
FIG. 27 is a bottom plan view of the DC bus stab of FIG. 23.

According to the illustrated embodiment, the connector system 10 includes a connector assembly 20 mounted to the top surface 14 of each power converter 12. Optionally, the connector assembly 20 may be connected to another surface of the power converter, 12 such as the front, rear, or lower surface as long the surfaces of adjacent power converter 12 on which the connector assembly 20 is mounted are substantially in the same geometric plane. Referring also to FIG. 4, the connector assembly 20 includes a DC bus stab 150 configured to be mounted to a circuit board 15 and to engage the connector assembly 20. A bus bar assembly 60 is used to connect connector assemblies 20 on adjacent power converters 12, as shown in FIG. 1.

Referring also to FIGS. 5-10, the connector assembly 20 includes a non-conductive housing 21 made, for example, from plastic and a contact 40 that is made of an electrically conductive material and mounted within the housing 21. According to one embodiment, the connector assembly 20 includes two receptacles 31 located on a lower face 22 of the connector assembly 20 and four receptacles 32 located on an upper face 23 of the connector assembly 20. According to another embodiment, the connector assembly 20 may include two receptacles 31 on the lower face 22 and two receptacles 32 on the upper face 23. It is contemplated that still other numbers of receptacles 31, 32 may be included on the lower face 22 and upper face 23, respectively. The housing 21 includes a front wall 24, a rear wall 25, a first side wall 26, and a second side wall 27 extending between the lower face 22 and the upper face 23. Each receptacle 32 in the upper face 23 includes an opening 28 extending downward from the upper face 23 along a portion of the height of the first side wall 26 and of the second side wall 27 such that a channel is defined in the housing 21 between the first side wall 26 and the second side wall 27 for each receptacle 32 with a divider wall 29 between adjacent receptacles 32. Below the openings 28 for the upper receptacles 32, the housing 21 forms a generally closed surface defined, in part, by each of the front wall 24, rear wall 25, first side wall 26, and second side wall 27. The lower face 22 is a generally open surface bounded along its periphery by each of the front wall 24, rear wall 25, first side wall 26, and second side wall 27. One of the divider walls 29 extends downward to the lower face 22 separating the lower face 22 into two openings 33, where each opening corresponds to one of the lower receptacles 31. The interior of the housing 21 is generally open and configured to receive the contact 40 of the connector assembly 20.

The housing 21 further includes at least one first retaining member 35 to secure the bus bar assembly 60 to the connector assembly 20. The first retaining member 35 extends laterally along and protrudes from each of the front wall 24 and the rear wall 25. The first retaining member 35 includes an upper surface 37, a lower surface 39, and a side surface 38 extending, at least in part, between the upper surface 37 and the lower surface 39. The first retaining member 35 also includes a beveled outer edge 36 sloping downward between the upper surface 37 and the side surface 38. The first retaining member 35 is configured to engage a complementary retaining clip 70 to positively retain a bus bar assembly 60 to the connector assembly 20.

The housing 21 also includes multiple second retaining members 100 to secure the connector assembly 20 to the power converter 12. Each of the second retaining members 100 includes a bracket 102 and a clip 110. The bracket 102 includes a first planar member 104 configured to be secured to either the front wall 24 or the rear wall 25 and a second planar member 106 projecting orthogonally from the first planar member 104. An opening 108 extends through the second planar member 106 and is configured to receive the clip 110 extending therethrough. The clip 110 includes a body 112, complementary to the opening 108, which is configured to extend through the opening, and a head 114 on a first end of the clip 110. The head 114 is configured to engage an upper surface of the second planar member 106 and to prevent the clip 110 from passing entirely through the opening 108. A second end of the clip 110, opposite the first end, is configured to engage the power converter 12 to positively retain the connector assembly 20 to the power converter 12. It is contemplated that various other configurations of the first and second retaining members 35, 100 may be utilized without deviating from the scope of the invention.

Referring next to FIGS. 11-16, a contact 40 for use in the connector assembly 20 described above is illustrated. According to one embodiment of the invention, the contact 40 has a "w" shape that includes one lower slot 41 configured to be positioned within one of the lower receptacles 31 of the connector assembly 20 and two upper slots 42, each upper slot 42 configured to be positioned within one of the upper receptacles 32 of the connector assembly 20. According to another embodiment of the invention, the contact 40 may have an "s" shape that includes one lower slot 41 configured to be positioned within the lower receptacle 31 of the connector assembly 20 and one upper slot 42 configured to be positioned within the upper receptacle 32 of the connector assembly 20. It is contemplated that the "s" shaped contact 40 may be used with a connector assembly having one lower receptacle 31 and one upper receptacle 32. Referring again to FIG. 5, each connector assembly 20 includes two "w" shaped contacts 40 resulting in two lower slots 41, one for each of the two lower receptacles 31 and four upper slots 42, one for each of the upper receptacles 32. Each contact 40 is made from an electrically conductive material, such as copper, so that a current may be conducted between a first object inserted into the lower slot 41 and a second objet inserted into the upper slot 42.

Each of the upper slots 42 is defined by a pair of leaves 50. Each leaf 50 extends generally from an upper face 43 to a lower face 44 and from a front face 45 to a rear face 46 of the contact 40. The upper slot 42 is formed between two of the leaves 50. The upper end of each leaf 50 is spaced apart a first distance and tapered together such that the spacing between each leaf 50 decreases for a first distance from the upper face 43 of the contact 40. According to one embodiment of the invention, the first distance is less than half of the height of the contact 40. A bend 51, which extends laterally along each leaf 50 from the front face 45 to the rear face 46 of the contact 40, in each leaf 50 is defined at the first distance from the upper face 43. Each leaf 50 is subsequently tapered apart from each other from the bend 51 to a lower end of each leaf 50 such that the spacing between each leaf 50 increases from the bend 51 to the lower end of each leaf 50. A lower arch 52 connects the lower end of each leaf 50, extending along the lower face 44 and from the front face 45 to the rear face 46 of the contact 40. The lower arch 52 is formed of a resilient material such that each leaf 50 may be deflected apart from each other when an object is inserted between the leaves 50 and return back to their original positions when the object is removed from between the leaves 50. Similarly, each leaf 50 may be formed of a resilient material, such that the insertion of an object may, for example, reduce the taper in each leaf 50 and removal of the object allows each leaf 50 to resume its original taper.

The lower slot 41 is defined by one of the leaves from each pair of leaves of the upper slots 42. Each of the pair of leaves are located adjacent to each other and the inner leaf 50 from each pair is joined by an upper arch 53 at the upper face 43 of the contact 40. The lower slot 41 is formed between each of these inner leaves 50. Similar to the lower arch 52, the upper arch 53 is formed of a resilient material such that each leaf 50 may be deflected apart from each other when an object is inserted between the leaves 50 and return back to their original positions when the object is removed from between the leaves 50. Although the present embodiment of the contact is defined by four leaves 50 alternately joined at a lower face 44 and an upper face 43 by arches to form the upper slots 42 and lower slots 41, respectively, it is contemplated that alternate configurations of the contact 40 may be utilized to define upper slots 42 and lower slots 41 without deviating from the scope of the invention.

Turning next to FIGS. 17-22, a bus bar assembly 60 is used to establish an electrical connection between connector assemblies 20 on adjacent power converters 12. The bus bar assembly 60 includes a housing 62 and at least one bus bar 80. The housing 62 is a generally "u" shaped member having an upper wall 63, a pair of side walls 65, a first end 66, and a second end 67. A clip portion 70 is integrally formed in the housing 62 on each side and at each of the first end 66 and the second end 67 of the housing 62. Each side wall 65 is joined to the upper wall 63 along an upper edge 68 of the housing 62 and extends longitudinally between clip portions 70 at each end 66, 67 of the housing 62. The clip portion 70 includes an arm 71 pivotally mounted to and extending downward from the upper edge 68 of the housing 62. According to the illustrated embodiment, the arm 71 is integrally formed with the housing 62 of a resilient material allowing the lower edge of the arm 71 to pivot about the edge 68 and return to its original position. A portion of the outer surface of the arm 71 proximate to the upper edge 68 defines a tab 72. A technician pressing on tabs of opposing anus causes the lower edge of the arm 71 to pivot outward. The inner face of the arm 71 includes a retaining tab 73 extending longitudinally along the inner face of the arm 71 and proximate to the lower edge of the arm 71. The retaining tab 73 projects inward into the housing 62 and includes a beveled surface 74 sloped outward and downward from the inner face of the retaining tab 73. The beveled surface 74 of the retaining tab 73 on the clip 70 is complementary to the beveled outer edge 36 of the first retaining member 35 on the connector assembly 20.

The housing 62 also includes at least one bus bar retaining member 75. The bus bar retaining member 75 is located, at least in part, within the channel of the housing 62 defined by the upper wall 63 and the pair of side walls 65. Each bus bar retaining member. 75 is recessed from the first end 66 and the second end 67 at least the width of the clip portion 70. The bus bar retaining member 75 extends downward from the upper wall 63 and between each of the side walls 65 into the channel of the housing 62, defining a generally planar member. The lower end 76 of the bus bar retaining member is generally aligned with the lower end of each side wall 65. Each bus bar retaining member 75 includes slots 78 configured to receive the bus bars 80. The slots 78 establish a friction fit between each bus bar 80 and the bus bar retaining member 75. The upper portion of the slot 78 may extend between the first end 66 and the second end 67 of the housing 62 along the inner surface of the upper wall 63. According to the illustrated embodiment, a first bus bar retaining member 75 is positioned interior to the clip portion 70 on the first end 66 and a second bus bar retaining member 75 is positioned interior to the clip portion 70 on the second end 67. Optionally, a single bus bar retaining member 75 may extend along a portion of, or substantially along the length of, the interior of the housing 62 between the first and second ends 66, 67.

The illustrated embodiment of the bus bar assembly 60 includes four bus bars 80. Optionally, the bus bar assembly 60 may include two bus bars 80 or other numbers of bus bars 80, corresponding to the number of receptacles 32 on the connector assembly 20. Each bus bar 80 is formed of a conductive material, such as copper. Each bus bar 80 has an upper surface 81, a lower surface 82, and a pair of side surfaces 83 each of which extends between opposite ends 84, defining a generally rectangular bar. The height of each side surface 83 is greater than the width of the upper surface 81 and the lower surface 82 and the bus bar 80 extends longitudinally within the housing 62 substantially between the first end 66 and the second end 67 of the housing 62. Each bus bar 80 may be inserted into slots 78 of the bus bar retaining member 75 and be retained by a friction fit and/or and adhesive. Optionally, the housing 62 may be molded over the bus bars 80.

Turning next to FIGS. 23-27, one embodiment of the DC bus stab 150 is illustrated. The DC bus stab 150 includes a plug portion 160 configured to engage a lower receptacle 31 of the connector assembly 20 and a mounting portion 170 configured to engage a printed circuit board 15. The mounting portion 170 includes a first wall 172 and a second wall 174. Each of the first wall 172 and the second wall 174 are generally planar surfaces parallel to and displaced from each other. A first edge of both the first wall 172 and the second wall 174 include a plurality of pins 176 protruding therefrom. The pins 176 are configured to be inserted into vias in the PCB 15 in order to solder the DC bus stab 150 to the PCB 15. Second edges, distal from the first edge, of both the first wall 172 and the second wall 174 are joined to each other. In the illustrated embodiment, an arched member 178 joins the second edge of each of the first wall 172 and the second wall 174. The plug portion 160 protrudes from the first wall 172 in a direction to engage the connector assembly 20. Referring also to FIG. 4, the DC bus stab 150 may be mounted proximate to an upper edge 16 of the PCB 15. Each of the first wall 172 and the second wall 174 extend orthogonal to the PCB 15. The plug portion 160 protrudes from the first wall 172 in the same plane as the first wall and towards the edge 16 of the PCB 15. The plug portion 160 includes an insertion edge 162 which may be beveled to facilitate insertion of the plug portion 160 into the lower slot 41 of the contact 40, which is, in turn, within the lower receptacle 31 of the connector assembly. It is contemplated that each of the plug portion 160, first wall 172, second wall 174, and arched member 178 of the DC bus stab 150 may be formed of a single member according to known metal cutting, stamping, and/or forming techniques. Optionally, the DC bus stab 150 may be formed from multiple members joined, for example, by soldering or brazing. It is further contemplated that various other configurations of the DC bus stab 150 may be utilized without deviating from the scope of the invention.

Figure 28:
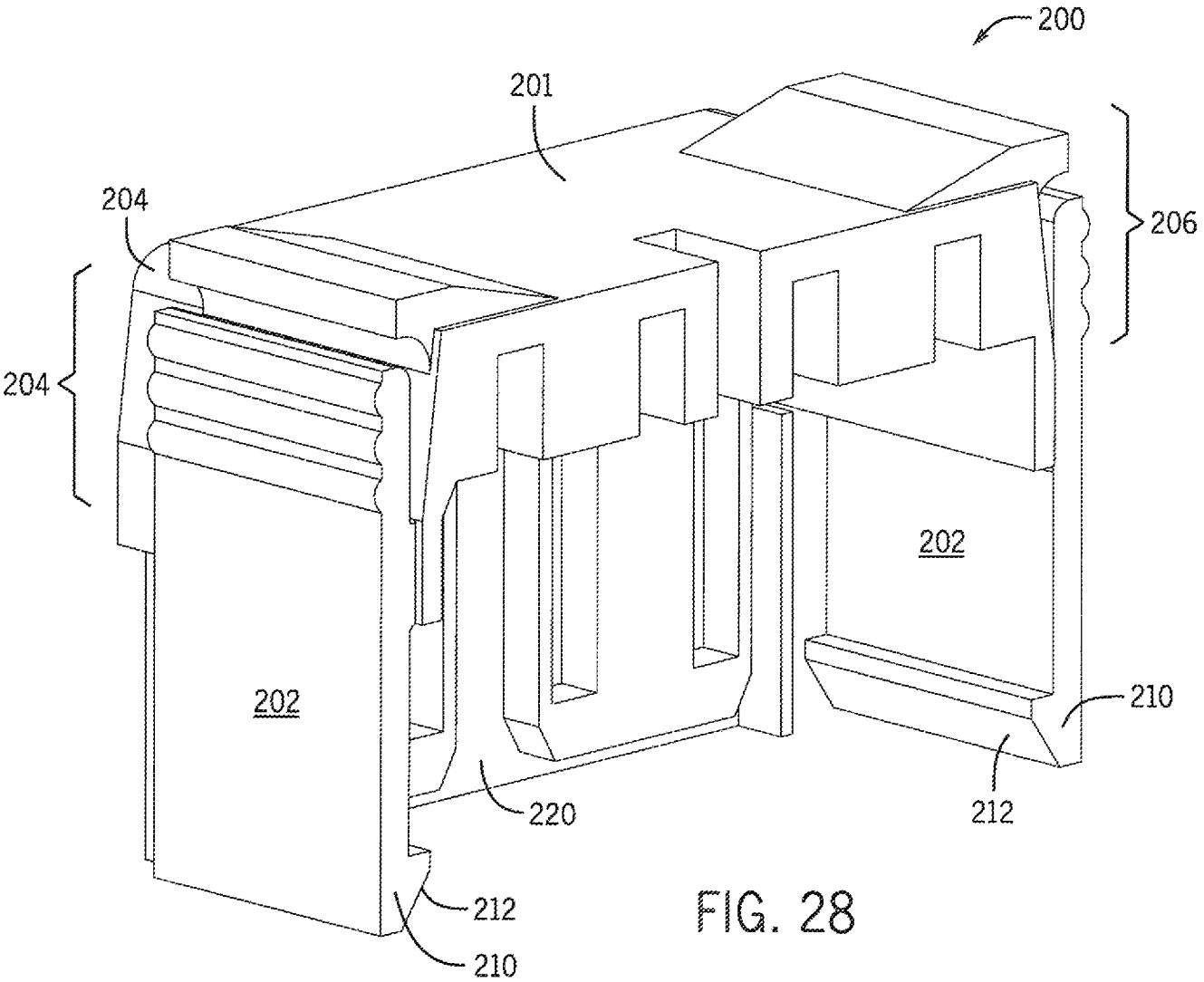
FIG. 28 is an isometric view of an end cap for the shared DC bus link according to one embodiment of the invention.

Referring next to FIG. 28, an end cap 200 for the connector system 10 is illustrated. The end cap 200 has similar construction to one end of the housing 62 for the bus bar assembly 60 and, in particular to of the dip portion 70 of the housing 62. Each side of the end cap 200 includes an arm 202 pivotally mounted to and extending downward from the upper edge 204 of the end cap 200. According to the illustrated embodiment, the arm 202 is integrally formed with the end cap 200 of a resilient material allowing the lower edge of the arm 202 to pivot about the upper edge 204 and return to its original position. A portion of the outer surface of the arm 202 proximate to the upper edge 204 defines a tab 206. A technician pressing on tabs 206 of opposing arms 202 causes the lower edge of the arm 202 to pivot outward. The inner face of the arm 202 includes a retaining tab 210 extending longitudinally along the inner face of the arm 202 and proximate to the lower edge of the arm 202. The retaining tab 210 projects inward into the end cap 200 and includes a beveled surface 212 sloped outward and downward from the inner face of the retaining tab 210. The beveled surface 212 of the retaining tab 210 on the end cap 200 is complementary to the beveled outer edge 36 of the first retaining member 35 on the connector assembly 20. An end wall 220, defining a closed surface extending substantially between each arm 202 and the upper wall 201 of the end cap 200 is configured to enclose the end of a connector assembly 20 when the end cap 200 is fit onto the connector assembly 20.

In operation, the connector system 10 establishes an electrical connection between power busses on adjacent devices. In the illustrated embodiment, multiple power converters 12 are sharing a DC bus. The power converters 12 are configured to have a predefined width, or one of a number of predefined widths, and are configured to be mounted on a control panel adjacent to each other. During assembly of the power converters 12, the DC bus stab 150 is mounted to a PCB 15 within each power converter 12. After the PCB 15 is mounted within a housing 13 of the power converter 12, the connector assembly 20 is connected to the DC bus stab 150. The connector assembly 20 is press fit onto the DC bus stab 150 such that the plug portion 160 of the DC bus stab 150 is inserted into a lower slot 41 of the contact 40 positioned within a lower receptacle 31 of the connector assembly 20. Insertion of the plug portion 160 into the lower slot 41 causes the leaves 50 to be deflected outward, applying a biasing force from each leaf 50 onto the sides of the plug portion 160, ensuring an electrical connection is made between the contact 40 and the DC bus stab 150.

As the connector assembly 20 is inserted on the DC bus stab 150, the second retaining members 100 are being inserted into mating holes in the top surface 14 of the converter housing 13. According to the illustrated embodiment, the body 112 of each second retaining member 100 is inserted into a corresponding hole on the top surface. The body 112 of the second retaining member 100 engages the housing 13 to retain the connector assembly 20 to the power converter 12.

The form factor of each power converter 12 and location of the PCB 15 within the power converter is configured such that a known distance exists between adjacent power converters 12. The power converters 12 are mounted to a control panel such that the top surface 14 of each power converter 12 is generally aligned. The connector assemblies 20 on adjacent power converters 12 are therefore similarly aligned. The width of each power converter 12 is selected from one of a predefined set of widths. For example, each power converter may have a width of 50 or 100 cm. The bus bar assembly 60 is similarly configured to have a length of either 50 or 100 cm such that it may span between adjacent power converters 12. In addition, a third width of the bus bar assembly 60 of 75 cm may be defined such that it spans between one power converter having a width of 50 cm and a second power converter having a width of 100 cm. It is contemplated that various configurations of widths of power converters 12 and lengths of bus bar assemblies 60 may be selected without deviating from the scope of the invention.

A bus bar assembly 60 of appropriate length is selected and press fit between two adjacent power converters 12. The first end 66 of the bus bar assembly 60 fits into one half of the connector assembly 20 on a first power converter 12 and the second end 67 of the bus bar assembly 60 fits into one half of the connector assembly 20 on the second, adjacent power converter 12. In order to share a DC bus between three or more power converters, a second bus bar assembly 60 is selected and the first end 66 of the second bus bar assembly 60 fits into the other half of the connector assembly 20 on the second power converter 12 and into one half of the connector assembly 20 on the third power converter 12. Still additional bus bar assemblies 60 may be selected and fit between subsequent adjacent connector assemblies 20 until each of the selected power converters 12 are sharing a DC bus.

As each bus bar assembly 60 is pressed into the connector assemblies 20, the clip portion 70 on each end positively retains the bus bar assembly 60 to the connector assembly 20. According to the illustrated embodiment, the beveled surface 74 of the retaining tab 73 engages the beveled edge 36 of the first retaining member 35 of the connector assembly 20. As the bus bar assembly 60 is pressed onto the connector assembly 20, the arm 71 is deflected outward until the retaining tab 73 passes the first retaining member 35. Once the retaining tab 73 is past the first retaining member 35, the biasing force of the arm 71 causes the retaining tab 73 to engage the front or rear wall 24, 25 of the connector assembly below the lower surface 39 of the first retaining member 35. Interference between the lower surface 39 of the first retaining member 35 and the retaining tab 73 prevents the bus bar assembly 60 from being removed without pressing on the tab 72 of the clip portion 70. Pressing on the tab 72 pivots the arm 71 outward such that the retaining tab 73 dears the first retaining member 35 allowing the bus bar assembly 60 to be removed from the connector assembly 20. It is contemplated that various other configurations of retaining members may be utilized without deviating from the scope of the invention.

The bus bars 80 establish a shared electrical connection between adjacent devices. Within the power converters 12, the DC bus includes a positive tail and a negative rail. It is desirable to establish an electrical connection for each of the rails between each power converter 12. The connector assembly 20 includes a first lower receptacle 31 configured to engage a first DC bus stab 150 connected to the positive rail and a second lower receptacle 31 configured to engage a second DC bus stab 150 connected to the negative rail. The connector assembly 20 may have two upper receptacles 32, one for each rail, or four upper receptacles 32, two for each rail. The number or receptacles for each rail may be determined as a function of the power requirements for the power converters 12. When a single upper receptacle 32 is utilized, an "s" shaped contact 40 is fit into the connector assembly 20. The "s" shaped contact 40 establishes an electrical connection between a single bus bar 80 and the rail. When two upper receptacles 32 are utilized, a "w" shaped contact 40 is fit into the connector assembly 20. The "w" shaped contact establishes an electrical connection between two bus bars 80 in parallel and the rail. Additional current may be conducted between parallel bus bars 80 than by a single bus bar 80.

The bus bar assembly 60 is preferably configured to connect both rails between adjacent power converters 12 in tandem. Thus, when a single bus bar 80 is required for each rail, the bus bar assembly 60 includes two bus bars 80, and when two bus bars 80 are required for each rail, the bus bar assembly 60 includes four bus bars 80. Optionally, two or more DC bus stabs 150 may be mounted on the PCB 15 and electrically connected to a single rail. Each of the DC bus stabs 150 may engage either an "s" shaped contact 40 or a "w" shaped contact 40, thereby increasing the number of bus bars 80 connected between adjacent power converters 12 and increasing the current capacity of the shared DC bus. Further, separate bus bar assemblies 60 may be utilized for each shared rail or for a single shared power rail between adjacent devices.

Finally, an end cap 200 is press fit over one half of the connector assembly 20 for the power converter 12 at each end of the multi-drive assembly. The connector assembly 20 at each end has only a single DC bus assembly 60 connecting the power converter 12 to an adjacent power converter 12. For the power converters 12 located between two adjacent power converters 12, there are two DC bus assemblies 60 fit into each connector assembly. The housings 62 of adjacent DC bus assemblies 60 abut each other, providing a finger-safe connection of the shared DC bus. The end cap 200 abuts the housing 62 of the DC bus assembly 60 in the end power converter 12 and the end wall 220 extends downward around the end of the connector assembly 20 covering the upper receptacles 32. Thus, the connector system 10 provides a touch-safe, shared power rail between adjacent devices with a modular and tool-less assembly.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention

We claim:

1. A connector system configured to share a direct current (DC) bus between a first power converter and a second power converter, the connector system, comprising:

a first DC bus stab having a plug portion and a mounting portion, wherein the mounting portion is configured to be fixedly mounted to a first printed circuit board (PCB), wherein the first PCB is mounted within the first power converter;

a second DC bus stab having a plug portion and a mounting portion, wherein the mounting portion is configured to be fixedly mounted to a second PCB, wherein the second PCB is mounted within the second power converter;

a first connector assembly including a first receptacle configured to removably receive the plug portion of the first DC bus stab and a second receptacle configured to extend exterior to the first power converter;

a second connector assembly including a first receptacle configured to removably receive the plug portion of the second DC bus stab and a second receptacle configured to extend exterior to the second power converter; and a bus bar assembly including:

a bus bar having a first end configured to be inserted into the second receptacle of the first connector assembly and a second end configured to be inserted into the second receptacle of the second connector assembly, and a non-conductive housing enclosing at least a portion of the bus bar between the first end and the second end.

2. The connector system of claim 1 wherein:

the first connector assembly further includes a third receptacle, wherein the third receptacle is configured to extend outside the first power converter, the second connector assembly further includes a third receptacle, wherein the third receptacle is configured to extend outside the second power converter, the bus bar of the bus bar assembly is a first bus bar, the bus bar assembly includes a second bus bar having a first end configured to be inserted into the third receptacle of the first connector assembly and a second end configured to be inserted into the third receptacle of the second connector assembly, and the non-conductive housing encloses at least a portion of the second bus bar between the first end and the second end.

3. The connector system of claim 1 wherein:

the first connector assembly further includes a first housing having a first portion configured to be interior to the first power converter and a second portion configured to be exterior to the first power converter, wherein the first housing includes a retainer on the second portion configured to positively retain the first connector assembly to the first power converter, and the second connector assembly further includes a second housing having a first portion configured to be interior to the second power converter and a second portion configured to be exterior to the second power converter, wherein the second housing includes a retainer on the second portion configured to positively retain the second connector assembly to the second power converter.

4. The connector system of claim 3 wherein the bus bar includes:

a first side proximate to the first and second power converters, a second side distal from the first and second power converters, and a third and a fourth side, each of the third and fourth sides extending between the first and second sides, and wherein the non-conductive housing extends longitudinally along each of the second, third, and fourth sides of the bus bar.

5. The connector system of claim 4 further comprising an end cap configured to cover a portion of the second receptacle of each of the first and the second power converters not receiving the bus bar.

6. The connector system of claim 4 wherein:

the second portion of each of the first housing and the second housing for the first and the second connector assemblies, respectively, includes a first half of a retainer, the non-conductive housing of the bus bar assembly includes a second half of the retainer, and when the bus bar assembly is inserted across the first and the second connector assemblies, the second half of the retainer engages the first half of the retainer to positively retain the bus bar assembly to the first and the second connector assemblies.

7. A connector for a device configured to share at least one power rail, the connector including:

a stab having a first portion and a second portion, wherein the first portion is configured to be fixedly mounted to a printed circuit board (PCB) to establish an electrical connection with a first power rail within the device; and a connector assembly including a first receptacle configured to removably receive the second portion of the stab and a second receptacle configured to extend outside of a housing for the device, wherein the second receptacle is configured to receive a first bus bar in a first portion of the second receptacle, to receive a second bus bar in a second portion of the second receptacle, and to establish an electrical connection between the first bus bar, the second bus bar, and the first power rail within the device.

8. The connector of claim 7 wherein the connector assembly includes a third receptacle configured to extend outside of the housing for the device and wherein the third receptacle is configured to receive a third bus bar in a first portion of the third receptacle, to receive a fourth bus bar in a second portion of the second receptacle, and to establish an electrical connection between the third bus bar, the fourth bus bar, and the first power rail within the device.

9. The connector of claim 7 wherein the stab is a first stab and the connector assembly is a first connector assembly, the connector further comprising a second stab having a first portion and a second portion, wherein the first portion of the second stab is configured to be fixedly mounted to the PCB to establish an electrical connection with a second power rail within the device; and a second connector assembly including a first receptacle configured to removably receive the second portion of the second stab and a second receptacle configured to extend outside of the housing for the device, wherein the second receptacle of the second connector assembly is configured to receive a third bus bar in a first portion of the second receptacle, to receive a fourth bus bar in a second portion of the third receptacle, and to establish an electrical connection between the third bus bar, the fourth bus bar, and the second power rail within the device.

10. The connector of claim 7 wherein the connector assembly includes a housing having a first portion configured to be interior to the device and a second portion configured to be exterior to the device and wherein the housing includes a retainer on the second portion configured to positively retain the first connector assembly to the device.

11. The connector of claim 10 wherein the second portion of the housing includes a first half of a second retainer, the bus bar includes a second half of the second retainer, and when the bus bar is inserted into the connector assembly, the second half of the second retainer engages the first half of the second retainer to positively retain the bus bar to the connector assembly.

12. The connector of claim 7 wherein the second receptacle of the connector assembly extends from one of a top surface, a front surface, and a rear surface of the housing for the device.

13. A connector for a shared DC bus, wherein the shared DC bus includes a positive rail and a negative rail, the connector including:

a first DC bus stab having a first portion and a second portion, wherein the first portion is configured to be fixedly mounted to a printed circuit board (PCB) and electrically connected to the positive rail of the DC bus;

a second DC bus stab having a first portion and a second portion, wherein the first portion is configured to be fixedly mounted to the PCB and electrically connected to the negative rail of the DC bus;

a first connector assembly including a first receptacle configured to removably receive the second portion of the first DC bus stab and a second receptacle, wherein the second receptacle is configured to receive a first bus bar in a first portion of the second receptacle, to receive a second bus bar in a second portion of the second receptacle and to establish an electrical connection between the first bus bar, the second bus bar, and the positive rail of the DC bus via the first connector assembly and the first DC bus stab; and a second connector assembly including a first receptacle configured to removably receive the second portion of the second DC bus stab and a second receptacle, wherein the second receptacle is configured to receive a third bus bar in a first portion of the second receptacle, to receive a fourth bus bar in a second portion of the second receptacle, and to establish an electrical connection between the third bus bar, the fourth bus bar, and the negative rail of the DC bus via the second connector assembly and the second DC bus stab.

14. The connector of claim 13 wherein:

the first connector assembly includes a third receptacle, wherein the third receptacle of the first connector assembly is configured to receive a fifth bus bar in a first portion of the third receptacle, to receive a sixth bus bar in a second portion of the third receptacle, and to establish an electrical connection between the fifth bus bar, the sixth bus bar, and the positive rail of the DC bus via the first connector assembly and the first DC bus stab; and the second connector assembly includes a third receptacle, wherein the third receptacle of the second connector assembly is configured to receive a seventh bus bar in a first portion of the third receptacle, to receive an eighth bus bar in a second portion of the third receptacle, and to establish an electrical connection between the seventh bus bar, the eighth bus bar, and the negative rail of the DC bus via the second connector assembly and the second DC bus stab.

15. The connector of claim 13 wherein:

the first connector assembly further includes a first housing having a first portion and a second portion, wherein the first housing includes a first retainer on the second portion configured to positively retain the first connector assembly to a device utilizing the shared DC bus, and the second connector assembly further includes a second housing having a first portion and a second portion, wherein the second housing includes a retainer on the second portion configured to positively retain the second connector assembly to the device.

16. The connector of claim 15 wherein the first housing is connected to the second housing.

17. The connector of claim 15 wherein the first housing and the second housing are integrally formed as a single housing.

18. The connector of claim 15 wherein:

the second portions of both the first housing and the second housing include a first half of a second retainer, the first bus bar and the third bus bar are at least partially enclosed by a housing, such that the first and third bus bars are inserted and removed in tandem;

the housing of the first bus bar and the third bus bar includes a second half of the second retainer, and when the first and the third bus bars are inserted into the first portion of the second receptacle of the first and the third connector assemblies, respectively, the second half of the second retainer engages the first half of the second retainer to positively retain the first and the third bus bars to the first and the second connector assemblies.

19. The connector of claim 13 wherein the second receptacles of both the first and the second connector assemblies extend from one of a top surface, a front surface, and a rear surface of the power converter.

* * * * *